US008622386B2

(12) United States Patent
Momoka et al.

(10) Patent No.: US 8,622,386 B2
(45) Date of Patent: Jan. 7, 2014

(54) SHEET STORAGE APPARATUS AND IMAGE FORMING APPARATUS

(75) Inventors: Toshiki Momoka, Tokyo (JP); Daisaku Kamiya, Abiko (JP); Hideki Kushida, Moriya (JP); Naoto Tokuma, Abiko (JP); Toshiyuki Iwata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/487,837

(22) Filed: Jun. 4, 2012

(65) Prior Publication Data

US 2012/0313313 A1 Dec. 13, 2012

(30) Foreign Application Priority Data

Jun. 10, 2011 (JP) ..... 2011-130511
May 22, 2012 (JP) ..... 2012-116714

(51) Int. Cl.
*B65H 31/08* (2006.01)

(52) U.S. Cl.
USPC ..... 271/212; 271/292; 271/293

(58) Field of Classification Search
USPC ..... 271/287, 292–295, 298, 299, 212, 181, 271/81, 177, 178, 180
See application file for complete search history.

(56) References Cited

U.S. PATENT DOCUMENTS

| | | | | | |
|---|---|---|---|---|---|
| 5,172,905 | A * | 12/1992 | Vanous et al. | ..... | 271/209 |
| 5,553,844 | A * | 9/1996 | Aaron | ..... | 271/293 |
| 5,722,030 | A | 2/1998 | Kato | | |
| 2012/0275839 | A1 * | 11/2012 | Kushida et al. | ..... | 400/623 |
| 2012/0288310 | A1 * | 11/2012 | Kamiya et al. | ..... | 399/381 |
| 2012/0313313 | A1 * | 12/2012 | Momoka et al. | ..... | 271/3.19 |
| 2012/0313317 | A1 * | 12/2012 | Gamo et al. | ..... | 271/225 |
| 2012/0319346 | A1 * | 12/2012 | Iwata et al. | ..... | 271/3.14 |

* cited by examiner

*Primary Examiner* — Michael McCullough
(74) *Attorney, Agent, or Firm* — Canon USA, Inc., IP Division

(57) ABSTRACT

A sheet storage apparatus having a sheet conveying portion and a sheet storage portion to receive the sheet as conveyed upward from below by the sheet conveying portion and to store the sheet in a vertical direction. The sheet storage portion includes a guide portion, first and second holding members. The first holding member forms a first nipping portion between the first holding member and the guide surface. The first holding member permits the sheet to be conveyed upward to pass through the first nipping portion, and holds the sheet by restricting the sheet from moving downward at the first nipping portion. The second holding member forms a second nipping portion between the second holding member and the guide surface. The second holding member permits the sheet to be conveyed upward to pass through the second nipping portion, and holds the sheet at the second nipping portion.

16 Claims, 17 Drawing Sheets

SHEET STORAGE APPARATUS AND IMAGE FORMING APPARATUS

BACKGROUND OF THE INVENTION

1. Field of the Invention

The present invention relates to a sheet storage apparatus that stores conveyed sheets.

2. Description of the Related Art

Conventionally, an image forming apparatus is provided with a sheet storage apparatus and is arranged to discharge sheets, on which images have been formed sequentially from an image forming portion, to the sheet storage apparatus. For instance, U.S. Pat. No. 5,722,030 (Kato) discloses an image forming apparatus provided with a bin-moving type sorter having a plurality of bins capable of storing printed sheets movably in a vertical direction.

The plurality of bin trays goes up or down one by one as spiral cams, provided on both sides of the trays, rotate once.

Each sheet on which an image has been formed in the body of the image forming apparatus is sent to the sorter by a pair of discharge rollers and is selectively sent in a direction of a sort path or a non-sort path by a change-over member. A sheet that has passed through the non-sort path is discharged onto a non-sort tray. A sheet that has passed through the sort path is discharged by another pair of discharge rollers and is stored on one bin tray of the bin trays that go up and down in synchronism with the discharge of the sheet. The sheets stored on the bin tray are aligned by an aligning bar that penetrates through cutaways provided in each bin tray and moves in a direction of a width of the sheet orthogonal to a direction in which the sheet is discharged. The sheets also undergo a stapling process carried out by an electrically-driven stapler as necessary.

The sheet storage apparatus of the image forming apparatus described above stacks and stores the sheets sequentially and flatly on the bin trays substantially horizontally disposed or gently inclined. Thus, the sheet storage apparatus has a layered structure of the plurality of bin trays, with the bin tray being changed per job of the discharged sheet and securely discriminating the discharged sheets. However, because the bin trays are positioned at different heights, visibility of the sheets stored in the low bin tray is not good and it is inconvenient to take the sheets out of the low bin trays in particular.

Furthermore, the sheets discharged onto the bin trays are not bundled in the stacked state, except in the case when the sheets are stapled as a bundle. As a result, there is a case when the sheets are disordered on the bin tray depending on a condition, e.g., curling, surface friction, and others, of the sheets during the discharge, or when one touches another sheet bundle by mistake in taking out the sheets out of the bin tray.

SUMMARY OF THE INVENTION

The present invention provides a sheet storage apparatus that is capable of favorably bundling vertically stored sheets, of improving visibility of the sheets, and of permitting the sheets to be taken out conveniently without a need to, for example, first staple the sheets as a bundle before vertically storing the sheets. According to an aspect of the present invention, a sheet storage apparatus includes a sheet conveying portion configured to convey a sheet, and a sheet storage portion configured to receive the sheet as conveyed upward from below by the sheet conveying portion and to store the sheet in a vertical direction, wherein the sheet storage portion includes: a guide portion having a guide surface set up in the vertical direction to guide the sheet, a first holding member configured to form a first nipping portion between the first holding member and the guide surface, wherein the first holding member is configured to permit the sheet to be conveyed upward to pass through the first nipping portion, and to hold the sheet by restricting the sheet from moving downward at the first nipping portion, and a second holding member configured to form a second nipping portion between the second holding member and the guide surface, wherein the second holding member is configured to permit the sheet to be conveyed upward to pass through the second nipping portion, and to hold the sheet by restricting the sheet from moving downward at the second nipping portion, wherein the second holding member is disposed downstream of the first holding member in a sheet conveying direction.

Further features of the present invention will become apparent from the following description of exemplary embodiments with reference to the following attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

First Embodiment

Figure 1:
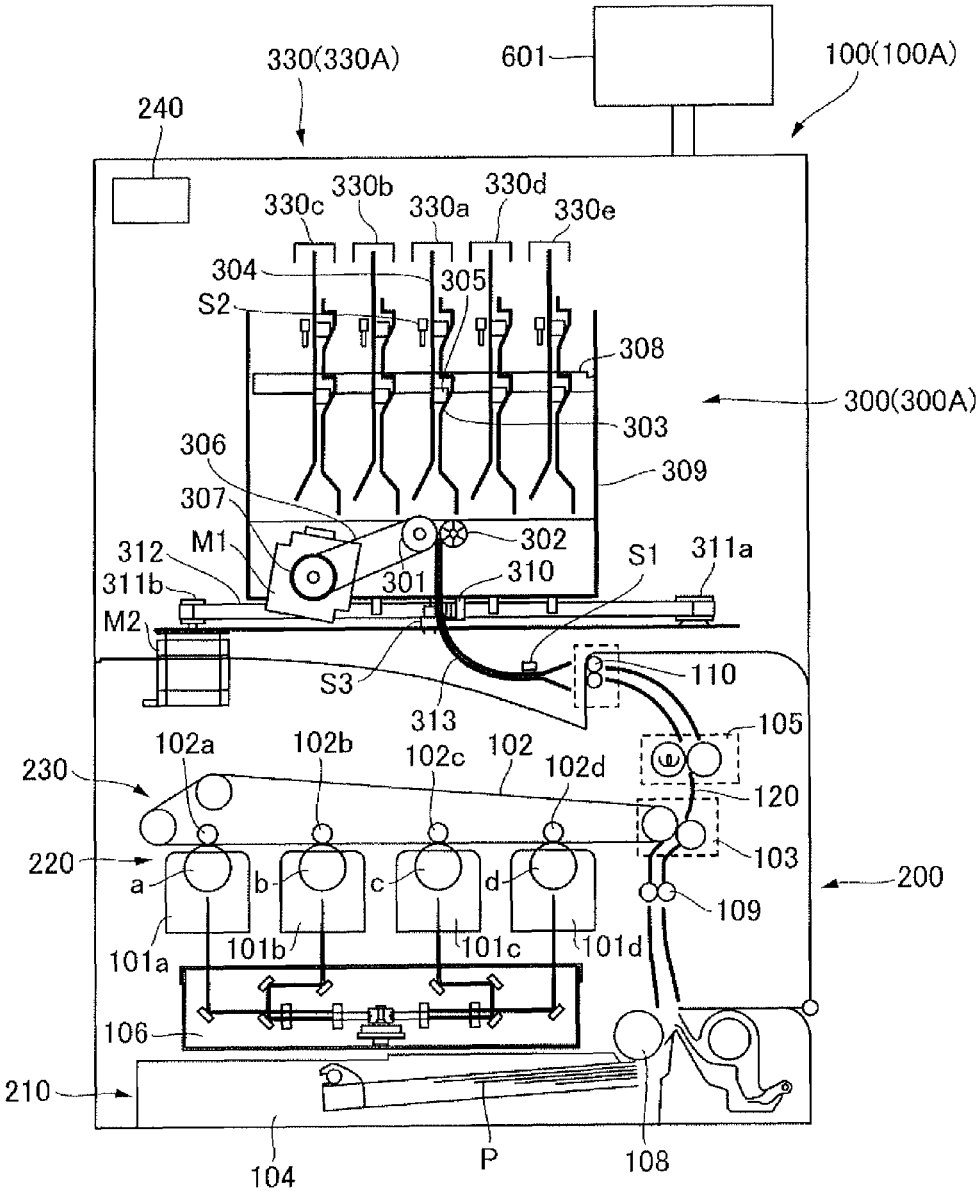
FIG. 1 is a section view showing an entire framework of an image forming apparatus of a first embodiment.

An image forming apparatus 100 of a first embodiment will be explained with reference to FIGS. 1 through 13. Firstly, a skeleton framework of the image forming apparatus 100 of the first embodiment will be explained along with movement of a sheet P in FIG. 1. FIG. 1 is a section view showing an entire framework of the image forming apparatus 100 of the first embodiment.

As shown in FIG. 1, the image forming apparatus 100 has a body 200 for forming an image on the sheet P (referred to as an "apparatus body" 200 hereinafter) and a sheet storage apparatus 300 for storing the sheet P on which the image has been formed by the apparatus body 200. The apparatus body 200 includes a sheet supplying portion 210 for feeding the sheet P, an image forming portion 220 for forming images, a transfer portion 230 for transferring the image formed in the image forming portion 220 onto the sheet P, and a fixing portion 105 for fixing the transferred image on the sheet P.

The sheet supplying portion 210 includes a sheet feeding cassette 104 for storing sheets P and a pickup roller 108 for feeding the sheets P stored in the sheet feeding cassette 104, one by one, to the transfer portion 230.

The image forming portion 220 includes photosensitive drums (a) through (d) for four colors of toner images of yellow, magenta, cyan and black, an exposure unit 106 for forming electrostatic latent images on the photosensitive drums (a) through (d) by irradiating laser beams based on image information, and other units. It is noted that these photosensitive drums (a) through (d) are driven by motors, not shown, and are also provided with primary charging units, developers, and transfer charging units, respectively, around the drums. These are unitized as process cartridges 101*a* through 101*d*.

The transfer portion 230 includes a transfer belt 102 rotated and driven in a predetermined direction, transfer charging units 102*a* through 102*d* for transferring toner images of the respective colors on the photosensitive drums to the transfer belt 102, and a secondary transfer portion 103 for secondarily transferring the toner images onto the sheet P. The fixing portion 105 is provided on a downstream side of the transfer portion 230 to fix the toner images to the sheet P by heat and pressure. It is noted that FIG. 1 also shows a central processing unit (CPU) circuit portion 240, which is a controller for controlling the apparatus body 200 and the sheet storage apparatus 300.

Next, an image forming operation of the apparatus body 200, constructed as described above, will be explained specifically. When the image forming operation starts, the exposure unit 106 irradiates laser light based on image information from a personal computer or the like, not shown, and exposes surfaces of the photosensitive drums (a) through (d) sequentially, which are charged uniformly with predetermined polarity and potential to form electrostatic latent images on the photosensitive drums (a) through (d). The electrostatic latent images formed on the photosensitive drums (a) through (d) are then visualized by developing using toners.

For instance, the laser light of an image signal of yellow component color of an original image is irradiated to the photosensitive drum (a) through a polygon mirror and the like of the exposure unit 106 to form a yellow electrostatic latent image on the photosensitive drum (a). Then, this yellow electrostatic latent image is developed by the yellow toner from the developer to visualize as a yellow toner image. Then, when the photosensitive drum (a) rotates and the yellow toner image comes to a primary transfer portion where the photosensitive drum (a) contacts with the transfer belt 102, the yellow toner image is transferred primarily to the transfer belt 102 by a primary transfer bias applied by the transfer charging unit 102*a*.

As the yellow toner image is primarily transferred to the transfer belt 102, magenta, cyan and black toner images formed on the photosensitive drums (b), (c), and (d) in a similar manner as described above are superimposed sequentially on the transfer belt 102 upon the yellow toner image already on the transfer belt 102. Thus, a full-color toner image is formed on the transfer belt 102.

At the same time as this toner image forming operation, the pickup roller 108 sends out the sheets P stored in the sheet feeding cassette 104 one by one. The sheet P then reaches a registration roller 109, and the registration roller 109 conveys the sheet P to the secondary transfer portion 103 at a predetermined time. Then, the full color toner image on the transfer belt 102 is completely transferred onto the sheet P by a secondary transfer bias applied to the secondary transfer portion 103.

The sheet P on which the toner image has been transferred is conveyed from the secondary transfer portion 103 to the fixing portion 105 via a transfer path 120. The toners on the sheet P are melted and color-mixed by receiving heat and pressure, and are fixed as a full-color image on the sheet P at the fixing portion 105. After that, the sheet P on which the image has been fixed is discharged by a pair of discharge rollers 110 provided on the downstream side of the fixing portion 105 and is conveyed to the sheet storage apparatus 300 disposed above the apparatus body 200 by passing through a curved conveyor guide 313, that will be described later. The image forming apparatus 100 additionally includes a conveying guide 303, a storage guide 304, and holding members 305 discussed in connection with FIG. 5 and a manipulating portion 601 discussed in connection with FIG. 9.

Figure 2:
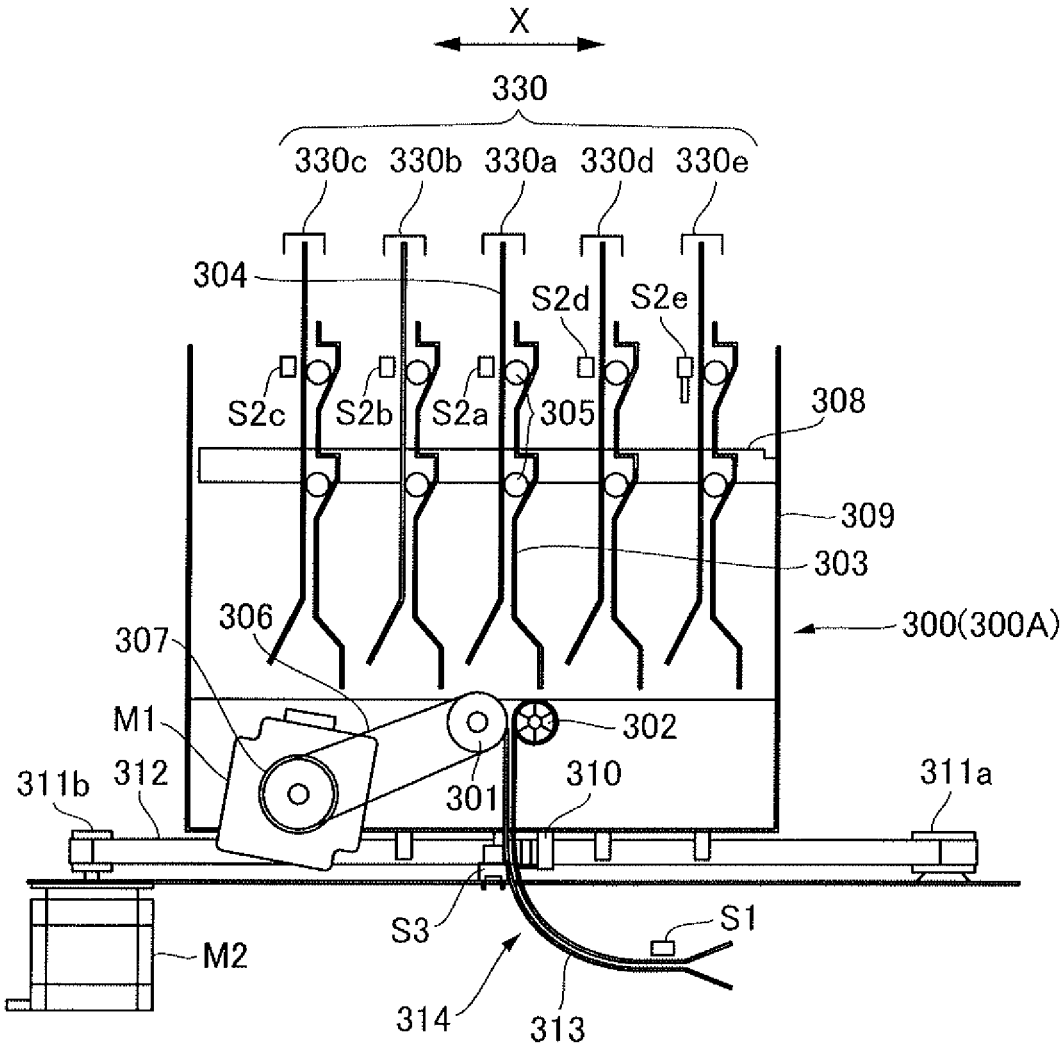
FIG. 2 is a section view of a sheet storage apparatus of the image forming apparatus of the first embodiment.
Figure 3:
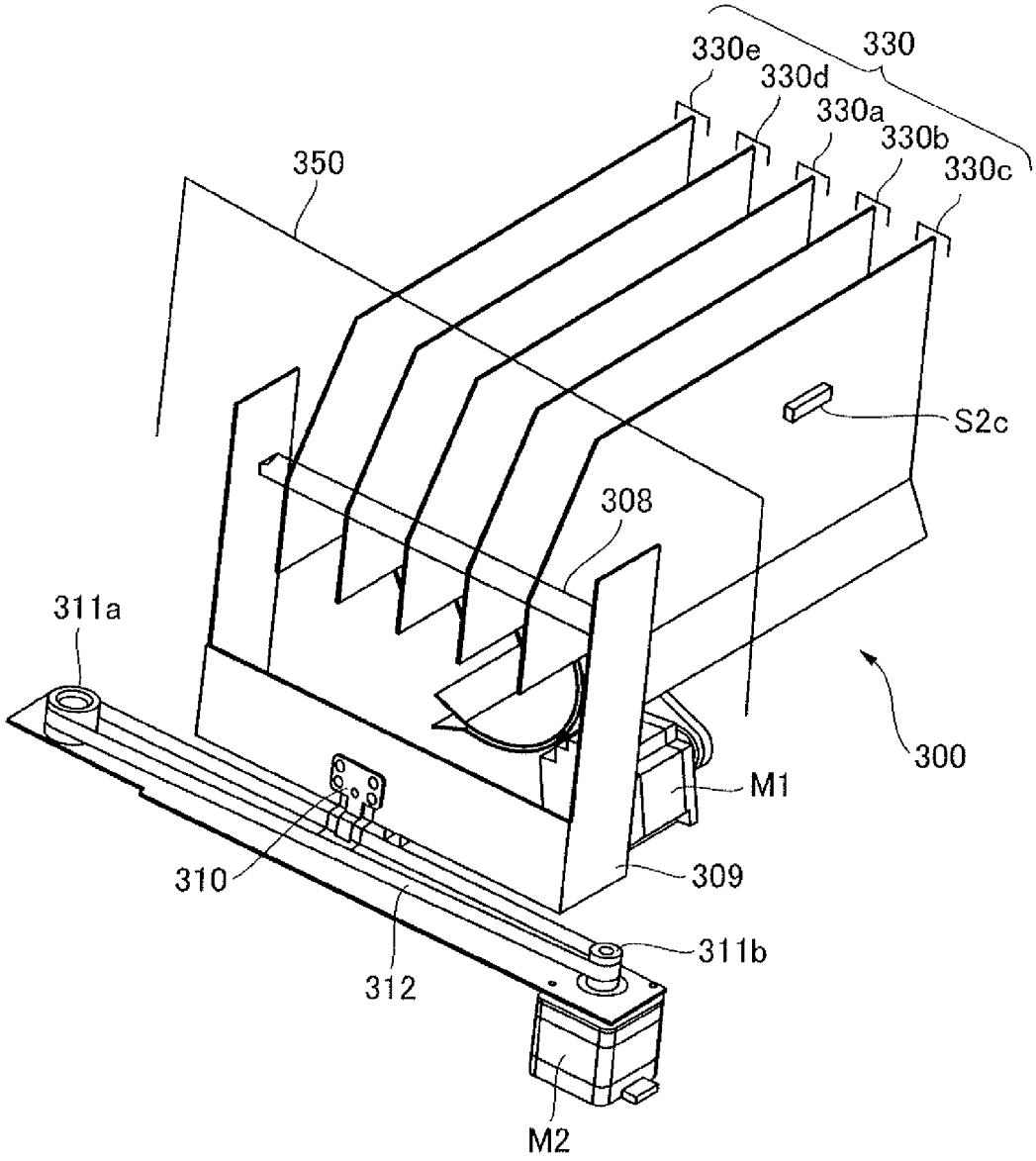
FIG. 3 is a perspective view of a sheet storage portion of the sheet storage apparatus of the first embodiment.
Figure 4:
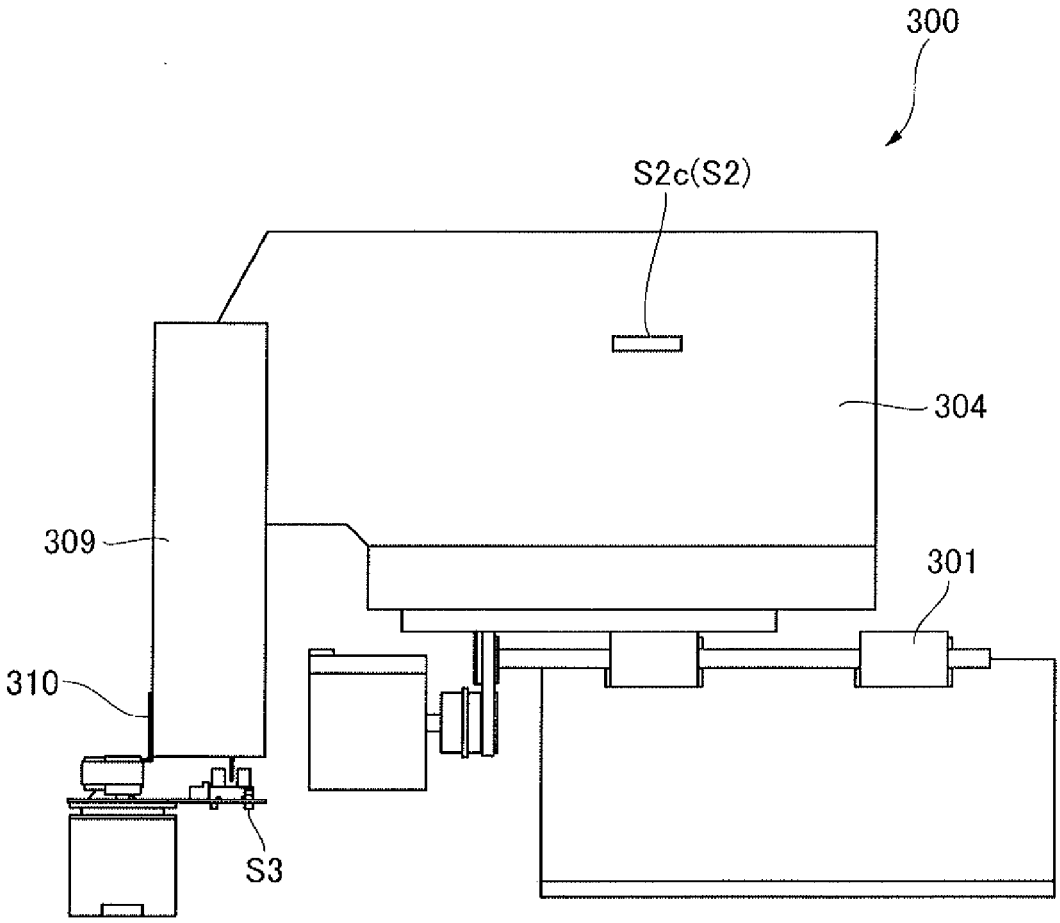
FIG. 4 is a side view of the sheet storage apparatus of the first embodiment.
Figure 5:
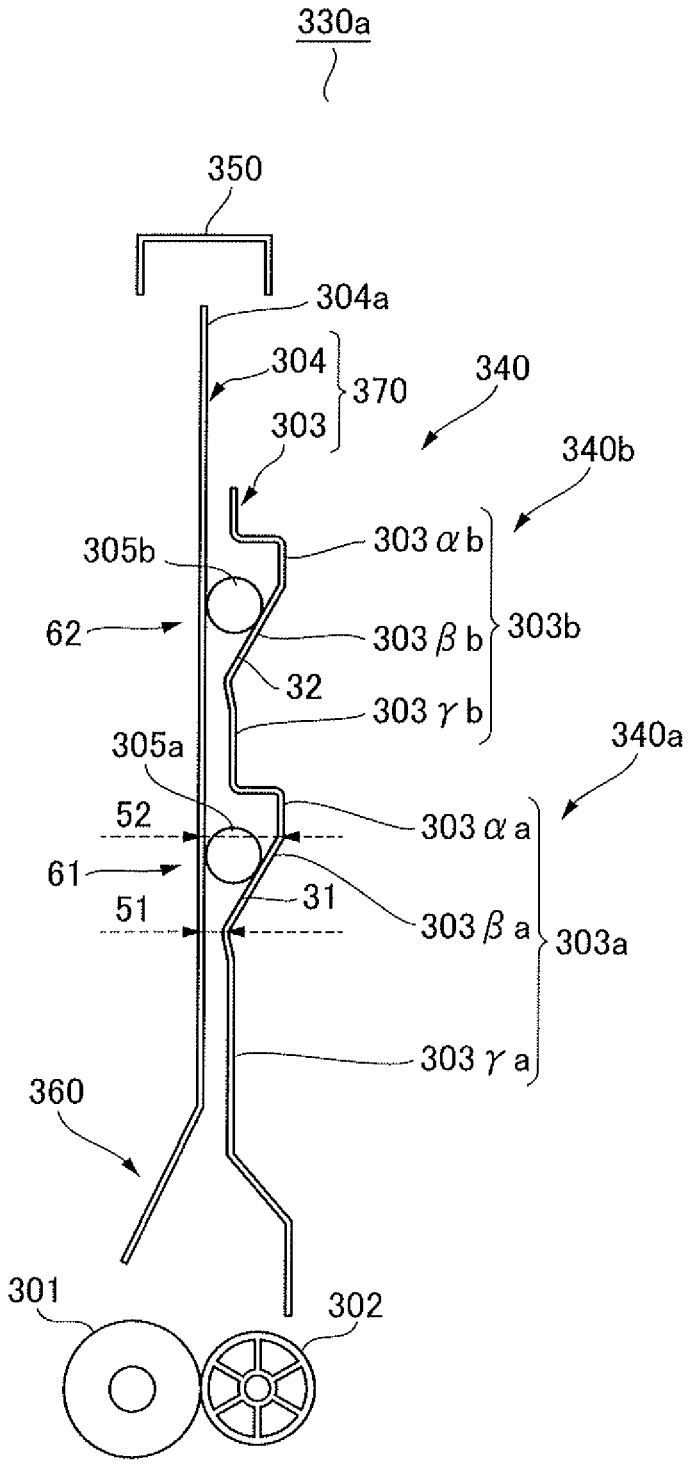
FIG. 5 is a section view of a sheet holding portion of the sheet storage portion of the first embodiment.

Next, the sheet storage apparatus 300 will be explained with reference to FIGS. 2 through 5, in addition to FIG. 1, along with the flow of the sheet P. FIG. 2 is a section view of the sheet storage apparatus 300 of the image forming apparatus 100 of the first embodiment, FIG. 3 is a perspective view of a sheet storage portion 330 of the sheet storage apparatus 300 of the first embodiment, FIG. 4 is a side view of the sheet storage apparatus 300 of the first embodiment, and FIG. 5 is a section view of a sheet holding portion 340 of the sheet storage portion 330 of the first embodiment.

As shown in FIG. 1, the sheet storage apparatus 300 is provided above the apparatus body 200 and is constructed so that the sheet P is conveyed (discharged) through a curved conveying guide 313 from the pair of discharge rollers 110 provided on the apparatus body 200, where the pair of discharge rollers 110 are driven by a sheet discharging motor (not shown). As shown in FIG. 2, an inlet sensor S1 is provided at an inlet portion of the conveying guide 313 to monitor conveying timing of the sheet P discharged out of the apparatus body 200. Provided at a downstream side of the conveying guide 313 are a conveying roller 301 that conveys the sheet discharged out of the apparatus body 200, and a driven roller 302 that press-contacts the conveying roller 301 and is driven by the conveying roller 301. The conveying roller 301, the driven roller 302, and the conveying guide 313 compose a sheet conveying portion 314 that conveys the sheet discharged out of the apparatus body 200.

The sheet P conveyed to the sheet storage apparatus 300 is further conveyed by the conveying roller 301 and the driven roller 302 to one sheet storage portion selected out of five sheet storage portions 330*a* through 330*e*, which will be described later. It is noted that the conveying roller 301 is rotated and driven by a driving gear 307 driven by a conveyor motor M1 (a driving unit) and a driving belt 306.

In the present embodiment, the sheet storage apparatus 300 has the five sheet storage portions 330*a* through 330*e* that receive the sheets P sequentially conveyed by the conveying roller 301 and the driven roller 302 from below thereof and store the sheet in a condition of setting a front edge of the sheet up and a rear edge down, i.e., in a condition of setting up the sheet in a vertical direction. The five sheet storage portions 330*a* through 330*e* are arrayed in a horizontal direction as shown in FIG. 3. Sensor S2*c* for detecting whether or not a sheet exists in sheet storage portion 330 is visible in FIG. 3. The sheet storage portions 330*a* through 330*e* are connected by a connecting shaft 308 and are held by a holding plate 309. The holding plate 309 is fixed with a connecting member 310 fixed to a timing belt 312 wrapped between moving pulleys 311*a* and 311*b*. The moving pulley 311*b* is provided coaxially with a motor M2 for moving the sheet storage portion 330, and the moving pulley 311*a* is provided on the side opposite from the moving pulley 311*b*. While the present embodiment utilizes the five sheet storage portions 330*a* through 330*e*, other embodiments may utilize i sheet storage portions 330*a* through 330*i*, where i is any positive whole number.

The five sheet storage portions 330*a* through 330*e* move in a body in a direction of an arrow X (in a horizontal direction) as shown in FIG. 2 because the holding plate 309 moves together with the connecting member 310 when the timing belt 312 rotates. Then, as the sheet storage portions 330*a* through 330*e* move in the horizontal direction, it becomes possible to change over which of the five sheet storage portions 330*a* through 330*e* faces the conveying roller 301, i.e., change the sheet storage portion 330*a* through 330*e* to which the conveying roller 301 is aligned in the vertical direction. That is, it becomes possible to store the sheet P conveyed from the conveying roller 301 to a particular sheet storage portion selected out of the five sheet storage portions 330*a* through 330*e* by changing relative positions of the fixed conveying roller 301 and the respective sheet storage portions 330*a* through 330*e*.

The sheet storage apparatus 300 is also provided with a home position detection sensor S3 that detects movement of and a home position of the connecting member 310 as shown in FIG. 4. A CPU 701 (FIG. 10) of a controller 636 determines the home position at a center in the X direction, i.e., in the lateral direction, shown in FIG. 2 using the sensor S3. The CPU 701 also determines a position where the sheet storage portions 330*a* through 330*e* receive the sheet P by counting a number of driving pulses of the motor M2 from the home position.

The sheet storage portions 330*a* through 330*e* are provided respectively with sensors (S2*a*) through (S2*e*) for detecting whether or not a sheet exists. Then, the CPU 701 determines whether or not each sheet storage portions is storing the sheet based on a detecting result of the sensors (S2*a*) through (S2*e*) and controls the position of the sheet storage portions 330*a* through 330*e* so that a next sheet P is stored in one of the sheet storage portions 330*a* through 330*e* storing no sheet. Each of sensors (S2*a*) through (S2*e*) may be referred to as a sheet detecting sensor S2 (see FIG. 1 and FIG. 4).

Next, each of the sheet storage portions 330, including the five sheet storage portions 330*a* through 330*e*, will be explained. It is noted that because the respective sheet storage portions 330*a* through 330*e* have the same configuration, they each will be explained below in reference to the sheet storage portion 330*a*.

Each of the five sheet storage portions 330*a* through 330*e* of the sheet storage portion 330 has a sheet holding portion 340 (see FIG. 5) that allows the sheet P to pass through in a sheet conveying direction and restricts the sheet P from moving in a direction opposite from the sheet conveying direction. An edge restricting member 350 is provided above sheet holding portion 340. Each of the five sheet storage portions 330*a* through 330*e* of the sheet storage portion 330 also has a receiving portion 360 provided on the upstream side of the sheet holding portion 340 to receive the sheets P conveyed sequentially from below by the conveying roller 301 and the driven roller 302.

The sheet holding portion 340 for sheet storage portion 330*a* has a first holding portion 340*a* provided on the upstream side of the sheet conveying direction and a second holding portion 340*b* provided on the downstream side, i.e., in the upper part in the vertical direction, of the first holding portion 340*a*.

Specifically, as shown in FIG. 5, the sheet storage portion 330*a* has a guide portion 370, which includes a storage guide 304, i.e., a first guide, as a guide member set up in the vertical direction, having a guide surface 304*a* formed substantially in the vertical direction to guide one surface of the sheet P and a conveying guide 303, i.e., a second guide provided to face to the storage guide 304. The sheet storage portion 330*a* also includes first and second holding members 305*a* and 305*b* provided between the storage guide 304 and the conveying guide 303.

Then, the guide portion 370, i.e. the storage guide 304 and the conveying guide 303, and the first and second holding members 305*a* and 305*b* configure the first and second holding portions 340*a* and 340*b*. The first holding portion 340*a* includes a conveying guide 303*a* as a first conveying guide and includes the first holding member 305*a* as a rolling member provided between the storage guide 304 and the conveying guide 303*a* to nip and hold the sheet P together with the storage guide 304 and its guide surface 304*a*. The second holding portion 340*b* includes a conveying guide 303*b* as a second conveying guide and includes the second holding member 305*b* as a rolling member provided between the storage guide 304 and the conveying guide 303*b* to nip and hold the sheet P together with the storage guide 304 and its guide surface 304*a*. The storage guide 304 forms a side wall of the first holding portion 340*a* and guides the sheet P received from the receiving portion 360 upward along the guide surface 304*a*.

The conveying guide 303*a* has a counterface wall portion 303$\alpha$*a* that is provided at an upper part thereof and a lower wall portion 303γ*a* that is provided at a lower part thereof. The lower wall portion 303γ*a* guides the sheet P received from the receiving portion 360 upward together with the storage guide 304. The conveying guide 303*a* also has an inclined portion 303β*a* as an inclined member provided in an upper part of the lower wall portion 303γ*a*, i.e., between the counterface wall portion 303α*a* and the lower wall portion 303γ*a*, and having an inclined surface 31 inclined in a direction of separating from and away from the storage guide 304. The inclined surface 31 of the inclined portion 303β*a* is formed so that a distance from the guide surface 304*a* of the storage guide 304 is widened from the lower part to the upper part thereof. That is, the inclined surface 31 of the conveying guide 303*a* is provided to face the storage guide 304 and is inclined so that a first distance 52 between an upper part of the inclined surface 31 and the guide surface 304*a* of the first guide 304 is greater than a second distance 51 between a lower part of the inclined surface 31 and the guide surface 304*a* of the first guide 304.

The first holding member 305*a* is columnar and rolls along the inclined surface 31 in a range of the inclined portion 303β*a* and the counterface wall portion 303α*a* of the conveying guide 303*a*. The first holding member 305*a* is in contact with the storage guide surface 304*a* and the inclined portion 303β*a* of the conveying guide 303*a* by its own weight until when a sheet is conveyed to the first holding portion 340*a*. That is, the first holding member 305*a* restricts at position where the first holding member 305*a* is received by the guide surface 304*a* of the storage guide 304 and the conveying guide 303*a* by its own weight and can roll in a direction in which the distance between the guides becomes large, i.e., in the upward direction.

Thus, the first holding member 305*a* forms a first nipping portion 61 together with the storage guide 304, and is a first rolling member that allows the sheet P to pass through the first nipping portion 61 by rolling when the sheet P conveyed upward enters the first nipping portion 61. More specifically, the first holding member 305*a* is arranged to allow the sheet P conveyed upward to pass through the first nipping portion 61 and to restrict the sheet P, whose front-end has passed through the first nipping portion 61, from moving downward. Thus, the first holding member 305*a* holds the sheet P.

The second holding portion 340*b* described above also has a same structure as the first holding portion 340*a*. That is, the second holding portion 340*b* includes the second holding member 305*b*, the storage guide 304, and the conveying guide 303*b*. The storage guide 304 and the conveying guide 303*b* are formed in common with those of the first holding portion 340*a*.

Thus, the conveying guide 303*b* is provided with the counterface wall portion 303αb, the inclined portion 303βb and the lower wall portion3 303γb formed for the holding portion. Then, the conveying guide 303 has two inclined surfaces: the first inclined surface 31 on which the first holding member 305*a* rolls and a second inclined surface 32 on which the second holding member 305*b* rolls.

The second holding member 305*b* also forms a second nipping portion 62 together with the storage guide 304, and is a second rolling member that allows the sheet P to pass through the second nipping portion 62 by rolling when the sheet P conveyed upward enters the second nipping portion 62. More specifically, the second holding member 305*b* is arranged to allow the sheet P conveyed upward to pass through the second nipping portion 62 and to restrict the sheet P, whose front-end has passed through the second nipping portion 62, from moving downward. Thus, the second holding member 305*b* holds the sheet P.

As described above, each sheet storage portion 330 has first and second holding portions 340*a* and 340*b* disposed at vertically different positions. Thereby, the first and second holding members 305*a* and 305*b* are disposed vertically along the guide surface of the conveying guide 303. Thus, each sheet storage portion 330 is constructed to be able to hold the plurality of sheets P stably via first and second holding members 305*a* and 305*b* disposed at the vertically different positions.

It is noted that lower end portions of the storage guide 304 and the conveying guide 303 are bent so that they separate from each other to form the receiving portion 360. That is, the lower end portion of the storage guide 304 is bent to separate from the conveying guide 303*a*.

The conveying guide 303 and/or the storage guide 304 are provided also with stoppers, not shown, to prevent the holding member 305*a* and/or 305*b* from falling out by moving in a depth direction, i.e., in the width direction or the sheet take-out direction, orthogonal to the sheet conveying direction within a range not hampering the conveyance of the sheet P.

Each sheet storage portion 330 also has the restricting member 350 (see FIG. 5) that restricts the upper-side front-end position of the stored sheet P. The restricting member 350 restricts the front-end position, i.e., the downstream-end position, of the sheets conveyed from the conveying roller 301 and the driven roller 302, and the sheets led by the sheet being conveyed, to align the level of the sheets.

Figure 6A:
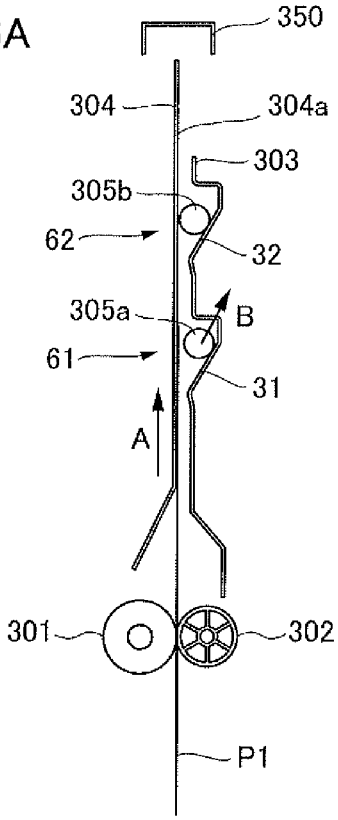
FIG. 6A illustrates a state when a preceding sheet passes through a first holding portion.

Next, an operation of holding the plurality of sheets P by the holding portion 340 will be explained with reference to FIG. 6A through FIG. 7C. Firstly, an operation of holding a fist sheet P1 (referred to as a "preceding sheet" P1 hereinafter) will be explained with reference to FIGS. 6A through 6C. Here, FIG. 6A illustrates a state when the preceding sheet P1 passes through the first holding portion 340*a*, FIG. 6B illustrates a state when the preceding sheet P1 passes through the second holding portion 340*b* and FIG. 6C illustrates a state when the preceding sheet P1 is held by the first and second holding portions 340*a* and 340*b*.

When the preceding sheet P1 is conveyed to a sheet storage portion 330 by the conveying roller 301, the first holding member 305*a* of the first holding portion 340*a* is pressed by the preceding sheet P1 that tries to enter the first nipping portion 61. When the first holding member 305*a* is pressed by the preceding sheet P1, the first holding member 305*a* moves (rolls) and elevates by a thickness of the preceding sheet P1 in a direction of an arrow B in FIG. 6A along the first inclined surface 31 of the conveying guide 303*a*. As a result, the preceding sheet P1 can pass through the first nipping portion 61, i.e., the first holding portion 340*a*. When the preceding sheet P1 passes through the first nipping portion 61, a nipping pressure F1 (=M/tan θ) in a direction of the storage guide 304 (see FIG. 6B) is applied to the preceding sheet P1 by the gravity M acting on the first holding member 305*a*. However, the preceding sheet P1 can pass through the first nipping portion 61 because the preceding sheet P1 presses the first holding member 305*a* by the conveying force of the conveying roller 301 and because the first holding member 305*a* is arranged to be freely rollable.

Figure 6B:
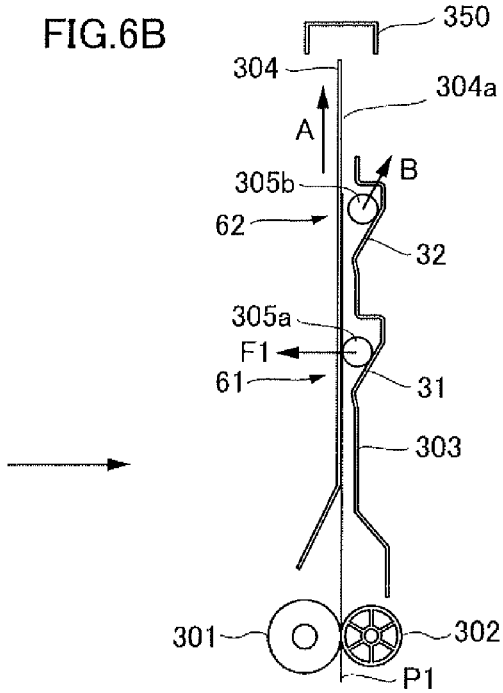
FIG. 6B illustrates a state when the preceding sheet passes through a second holding portion.
Figure 6C:
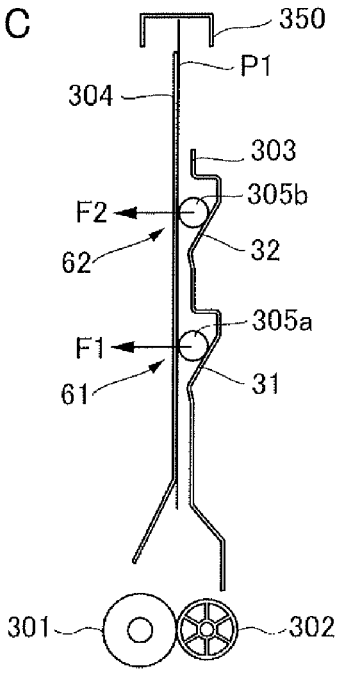
FIG. 6C illustrates a state when the preceding sheet is held by the first and second holding portions.

When the preceding sheet P1 is conveyed upward further by the conveying roller 301, the second holding member 305*b* of the second holding portion 340*b* is pressed by the preceding sheet P1 that tries to enter the second nipping portion 62 as shown in FIG. 6B. When the second holding member 305*b* is pressed by the preceding sheet P1, the second holding member 305*b* moves (rolls) and elevates by the thickness of the preceding sheet P1 in the direction of the arrow B in FIG. 6B along the second inclined surface 32 of the conveying guide 303*b*. As a result, the preceding sheet P1 can pass through the second nipping portion 62, i.e., the second holding portion 340*b*. When the preceding sheet P1 passes through the second nipping portion 62, a nipping pressure F2 (=M/tan θ) in the direction of the storage guide 304 (see FIG. 6C) is applied also here to the preceding sheet P1 by the gravity M acting on the second holding member 305*b*. However, the preceding sheet P1 can pass through the second nipping portion 62, i.e., the second holding portion 340*b*, because the preceding sheet P1 presses the second holding member 305*b* by the conveying force of the conveying roller 301 and because the second holding member 305*b* is arranged to be freely rollable.

Next, when a trailing end of the preceding sheet P1 passes through the conveying roller 301, the conveying force of the conveying roller 301 becomes inactive on the preceding sheet P1 and the pressure of the preceding sheet P1 applied to the first and second holding members 305*a* and 305*b* is released. When the pressure of the preceding sheet P1 is released, the first and second holding members 305*a* and 305*b* drop under their own weight and exert the nipping pressure on the preceding sheet P1 with the storage guide 304 and the first and second inclined surfaces 31, 32 of the conveying guide 303. Then, as shown in FIG. 6C, the first and second holding portion 340*a* and 340*b* hold the preceding sheet P1 by the nipping pressures F1 and F2 caused by wedge effect at the first and second inclined surfaces 31, 32.

Next, an operation of holding a second sheet P2 (referred to as a "succeeding sheet" P2 hereinafter) will be explained with reference to FIGS. 7A through 7C. Here, FIG. 7A illustrates a state when the succeeding sheet P2 passes through the first holding portion 340*a*, FIG. 7B illustrates a state when the succeeding sheet P2 passes through the second holding portion 340*b*, and FIG. 7C illustrates a state when the preceding and succeeding sheets P1 and P2 are held by the first and second holding portions 340*a* and 340*b*.

Figure 7A:
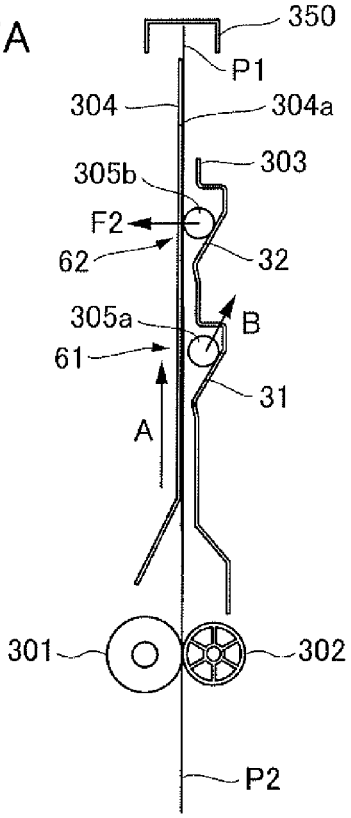
FIG. 7A illustrates a state when a succeeding sheet passes through the first holding portion.
Figure 7B:
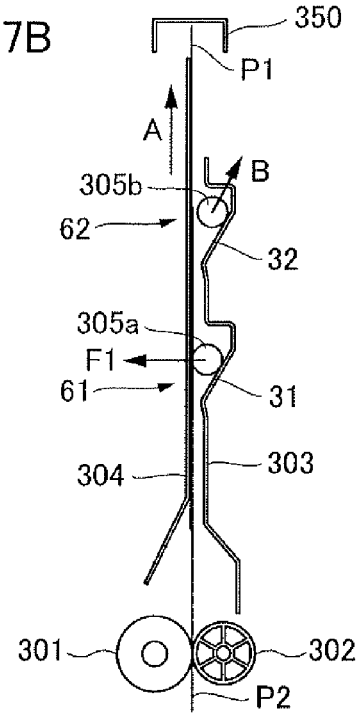
FIG. 7B illustrates a state when the succeeding sheet passes through the second holding portion.
Figure 7C:
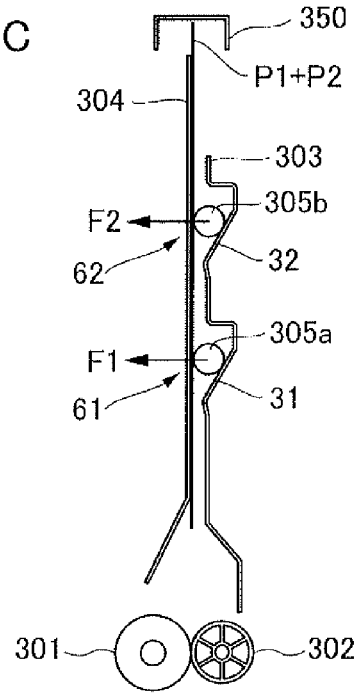
FIG. 7C illustrates a state when the preceding and succeeding sheets are held by the first and second holding portions.

When the succeeding sheet P2 is conveyed to the sheet storage portion 330 in the state in which the preceding sheet P1 is held by the holding portion 340, the first holding member 305*a* is pressed by the succeeding sheet P2 that tries to enter the first nip portion 61 as shown in FIG. 7A. When the first holding member 305*a* is pressed by the succeeding sheet P2, the first holding member 305*a* moves or elevates by a thickness of the succeeding sheet P2 in the direction of the arrow B in FIG. 7A along the first inclined surface 31 of the conveying guide 303*b*. As a result, the succeeding sheet P2 can pass through the first holding portion 340*a*.

At this time, while the nipping pressure F1 caused by the first holding member 305*a* is released as the first holding member 305*a* moves up, the preceding sheet P1 is held by the nipping pressure F2 of the second holding member 305*b*. Due to that, even if the nipping pressure F1 caused by the first holding member 305*a* is released, no defective phenomenon such as a fall of the preceding sheet P1 occurs. That is, the second holding member 305*b* applies the nipping pressure F2 to the preceding sheet P1 held at the second nipping portion 62 and restricts the held preceding sheet P1 from moving downward when the succeeding sheet P2 to be conveyed upward enters the first nipping portion 61.

When the succeeding sheet P2 passes through the first nipping portion 61, the nipping pressure F1 (=M/tan θ) in the direction of the storage guide 304 (see FIG. 7B) is applied to the preceding and succeeding sheets P1 and P2 by the gravity M acting on the first holding member 305*a*. However, the succeeding sheet P2 can pass through the first nipping portion 61, i.e., the first holding portion 340*a*, because a conveying force of the conveying roller 301 presses the succeeding sheet P2 against the first holding member 305*a* and because the first holding member 305*a* is arranged to be freely rollable.

When the succeeding sheet P2 is conveyed upward further by the conveying roller 301, the second holding member 305*b* of the second holding portion 340*b* is pressed by the succeeding sheet P2 that tries to enter the second nipping portion 62 as shown in FIG. 7B. When the second holding member 305*b* is pressed by the succeeding sheet P2, the second holding member 305*b* moves (rolls) and elevates by the thickness of the succeeding sheet P2 in the direction of the arrow B in FIG. 7B along the second inclined surface 32 of the conveying guide 303*b*. Thereby, the succeeding sheet P2 can pass through the second nipping portion 62, i.e., the second holding portion 340*b*. It is noted that when the succeeding sheet P2 passes through the second nipping portion 62, the nipping pressure F2 (=M/tan θ) in the direction of the storage guide 304 (see FIG. 7C) is applied to the preceding and succeeding sheets P1 and P2 by the gravity M acting on the second holding member 305*b*. However, the succeeding sheet P2 can pass through the second nipping portion 62, i.e., the second holding portion 340*b*, because a conveying force of the conveying roller 301 presses the succeeding sheet P2 against the second holding member 305*b* and because the second holding member 305*b* is arranged to be freely rollable.

When the succeeding sheet P2 enters the second nipping portion 62, the nipping pressure F2 caused by the second holding member 305*b* is released as the second holding member 305*b* moves up. However, the preceding sheet P1 and the succeeding sheet P2 are held by the nipping pressure F1 of the first holding member 305*a* (see FIG. 7C). Due to that, even if the nipping pressure F2 caused by the second holding member 305*b* is released, no defective phenomenon such as the fall of the preceding and succeeding sheets P1 and P2 occurs. That is, the first holding member 305*a* applies the nipping pressure F1 to the preceding sheet P1 held at the first nipping portion 61 and restricts the held preceding sheet P1 from moving downward when the succeeding sheet P2 to be conveyed upward enters the second nipping portion 62.

Next, when a trailing end of the succeeding sheet P2 passes through the conveying roller 301, the conveying force of the conveying roller 301 becomes inactive on the succeeding sheet P2 and the pressure of the succeeding sheet P2 applied to the first and second holding members 305*a* and 305*b* is released. When the pressure of the succeeding sheet P2 is released, the first and second holding members 305*a* and 305*b* drop under their own weight and exert the nipping pressures on the preceding and succeeding sheets P1 and P2 with the storage guide 304 and the first and second inclined surfaces 31 and 32 of the conveying guide 303*b*. Then, as shown in FIG. 7C, the first and second holding portions 340*a* and 340*b* hold the preceding and succeeding sheets P1 and P2 by the nipping pressures F1 and F2 caused by the wedge effects.

As described above, it is possible to store the plurality of sheets P in the sheet storage portion 330 by holding the sheet to be held by either one of the first and second holding members 305*a* and 305*b* even when the succeeding sheet P2 enters the first and second holding portions 340*a* and 340*b* in the state in which the preceding sheet P1 is held. In particular, it is possible to hold the held sheet securely by either one of the first and second holding members 305*a* and 305*b*, even if a front-end of the succeeding sheet P2 to be conveyed is deformed by curling and the like.

Figure 8:
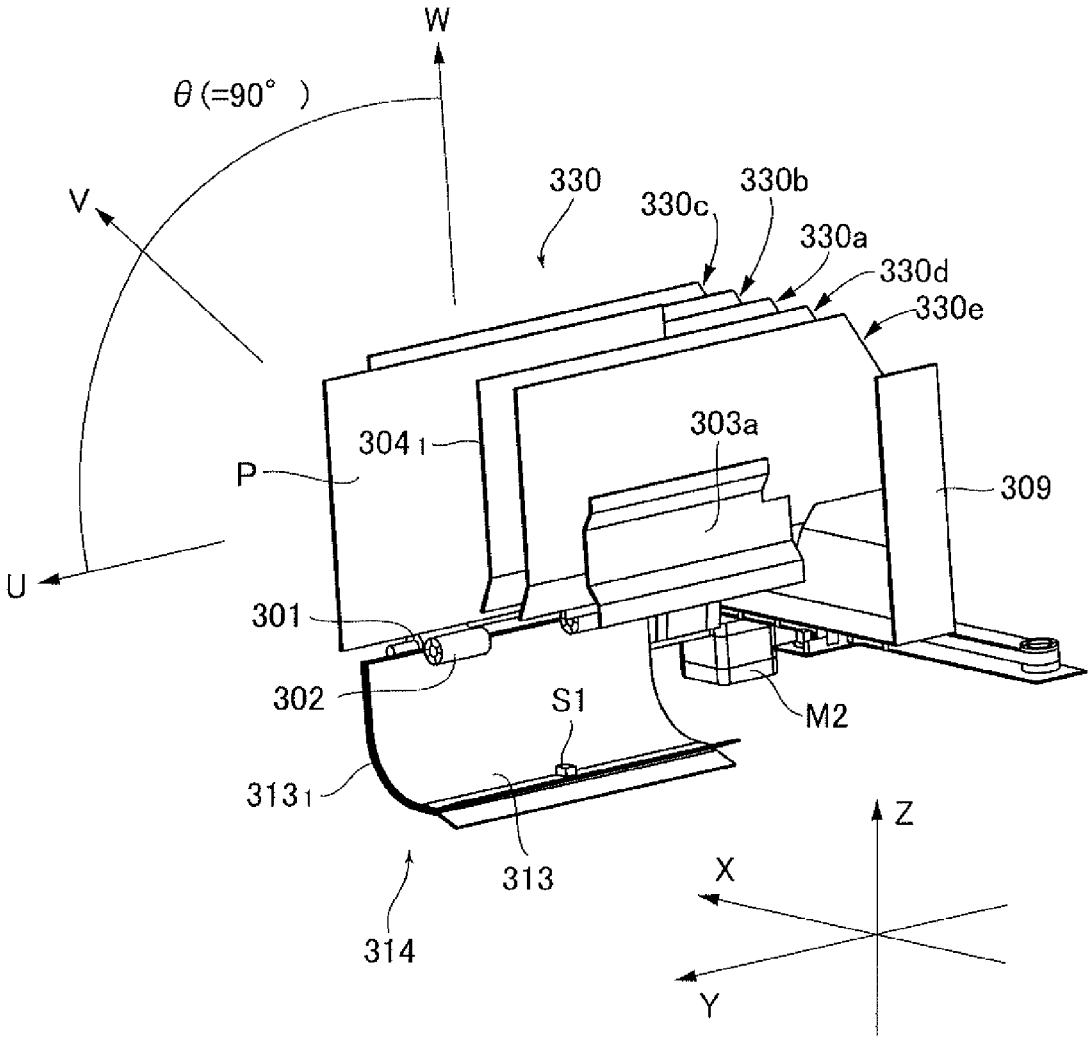
FIG. 8 is a perspective view illustrating a state of the sheets held in the sheet storage portion.

FIG. 8 shows a state of the sheet P held in the sheet storage portion 330*a* of the sheet storage portions 330. As shown in FIG. 8, the sheet holding portion 340 is disposed within the sheet storage portion 330*a* at a back of the sheet storage portion 330*a* in the depth direction Y orthogonal to the conveying direction Z of the sheet conveyed upward along the guide surface 304*a* of the storage guide 304. As noted above, the conveying roller 301, the driven roller 302, and the conveying guide 313 compose a sheet conveying portion 314 that conveys the sheet discharged out of the apparatus body 200. The sheet conveying portion 314 is disposed at a position that is shifted in the depth direction Y, i.e., in the width direction, from the plurality of sheet storage portions 330.

With this arrangement, the near side of the sheet P projects out of the near side of the sheet storage portion 330*a*, i.e., of the near side of the apparatus body 200, when the sheet P is held by the sheet holding portion 340. Here, the depth direction or the width direction Y is a direction in which a user of the apparatus takes out the sheet, the near side is a front side of the image forming apparatus 100 when the user faces the image forming apparatus 100 to take out the sheet and the back side is the side opposite from the near side.

More specifically, the sheet conveying portion 314 comprises the conveying guide 313 (third guide), the conveying roller 301 and the driven roller 302 as described above. The sheet conveying portion 314 is disposed in tandem in the depth direction Y with the motor M2 that moves the sheet storage portion 330 in a direction X for stacking the sheets P, and is positioned on the near side of the motor M2. Then, an end $\mathbf{313}_1$ on the near side of the conveying guide 313 is arranged to shift on the side opposite from the motor M2 more than an end $\mathbf{304}_1$ on the near side of the storage guide 304. As a result, the sheet P conveyed from the sheet conveying portion 314 is held while projecting outward from the holding portion 340 on the near side.

Still further, a length in a height direction, i.e., in the vertical direction Z, of the holding portion 340 of the sheet storage portion 330*a* is set so that an upper part of the stored sheet P projects out from the sheet storage portion 330*a*. That is, lengths in the height and depth directions of the sheet storage portion 330*a* are set so that the downstream-side end in the sheet conveying direction and the near-side end of the stored sheet P project out of the sheet storage portion 330*a*. With this arrangement, the sheet P stored in the sheet storage portion 330*a* can be taken out in a range of a direction U on the near side of the apparatus body, a direction V obliquely upward on the near side of the apparatus body and an upward direction W indicated by an angle θ (=90°) in FIG. 8.

Because the sheet P both projects out above the sheet storage portion 330*a* and out on the near side of the sheet storage portion 330*a* when the sheet P is stored in the sheet storage portion 330*a* as described above (or in any sheet storage portion 330), this projecting part is effective as a tong hold in taking out the sheet P. Then, if the sheet P (bundle of sheets) is pulled out to the near side of the apparatus body 200, to the obliquely upward direction of the apparatus body 200 and the upward direction as indicated by an arrow A in FIG. 6A, the wedge effect caused by the holding members 305*a* and 305*b* does not act. Accordingly, the sheet P (bundle of sheets) can be taken out of the sheet storage portion 330 readily by one hand.

Next, a CPU circuit portion 630 as a controller of the image forming apparatus 100 of the present embodiment will be explained with reference to FIGS. 9 and 10. Here, FIG. 9 is a control block diagram for controlling the apparatus body 200 and the sheet storage apparatus 300 of the present embodiment and FIG. 10 is a control block diagram of the controller 636 for controlling the sheet storage apparatus 300 of the present embodiment.

Figure 9:
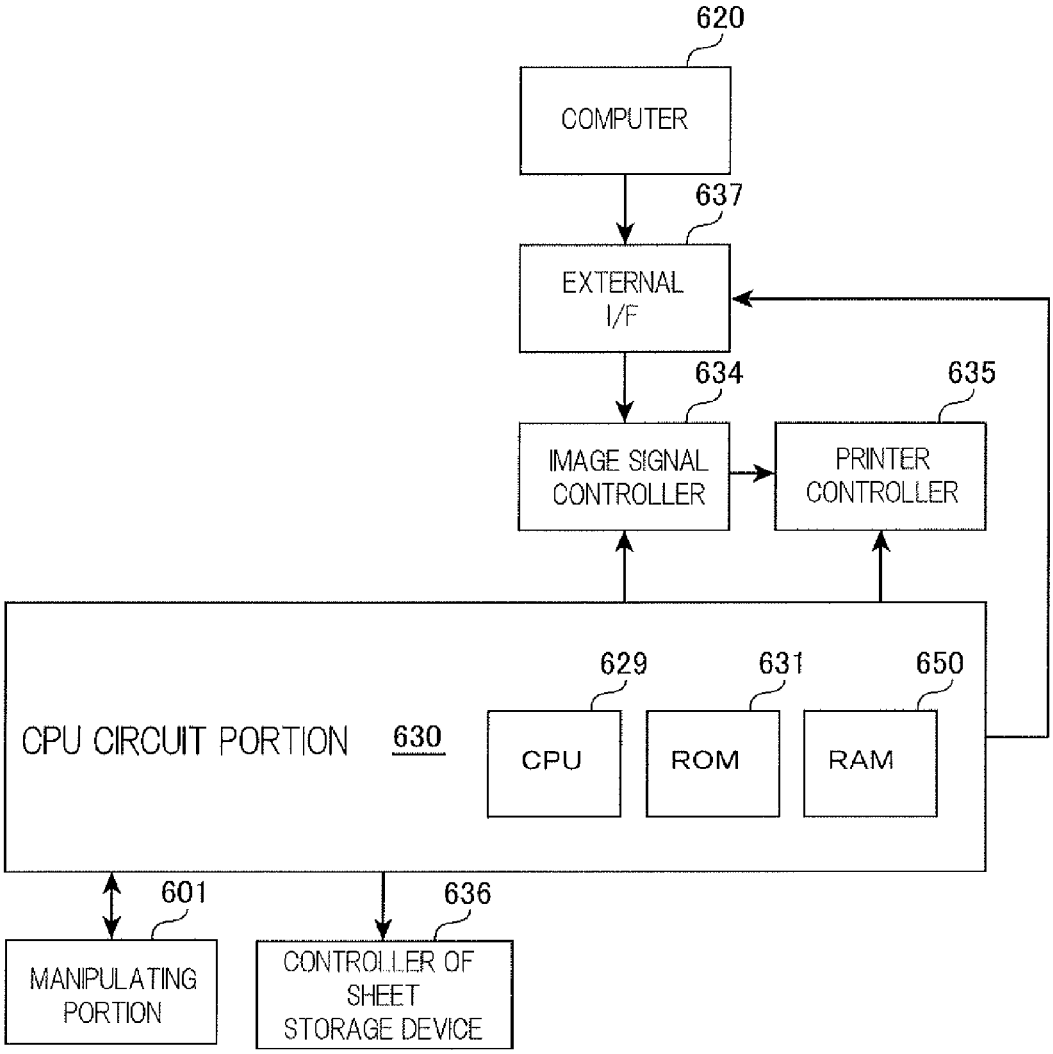
FIG. 9 is a control block diagram for controlling an apparatus body and the sheet storage apparatus of the first embodiment.

As shown in FIG. 9, the CPU circuit portion 630 has a central processing unit (CPU) 629, a read only memory (ROM 631), and a random access memory (RAM) 650. The CPU circuit portion 630 controls an image signal controller 634, a printer controller 635, a controller 636 for controlling the sheet storage device or apparatus 300, an external interface (I/F) 637, which is an interface with an external personal computer (PC) 620, and others. It is noted that the CPU circuit portion 630 controls a controller 636 described later and others in accordance with programs stored in the ROM 631 and a manipulating portion 601 provided on an upper surface of the sheet storage apparatus 300 shown in FIG. 1.

The image signal controller 634 inputs image data inputted from the external PC 620 through the external interface 637 to the printer controller 635 and the printer controller 635 controls the apparatus body 200 based on the image data. The controller 636 is mounted in the sheet storage apparatus 300 and controls and drives the entire sheet storage apparatus 300 by exchanging information with the CPU circuit portion 630. It is noted that although the controller 636 is mounted in the sheet storage apparatus 300 in the present embodiment, the invention is not limited to such a case. The sheet storage apparatus controller 636 may be provided in the apparatus body 200 integrally with the CPU circuit portion 630 to control the sheet storage apparatus 300 from the apparatus body 200 side of image forming apparatus 100.

Figure 10:
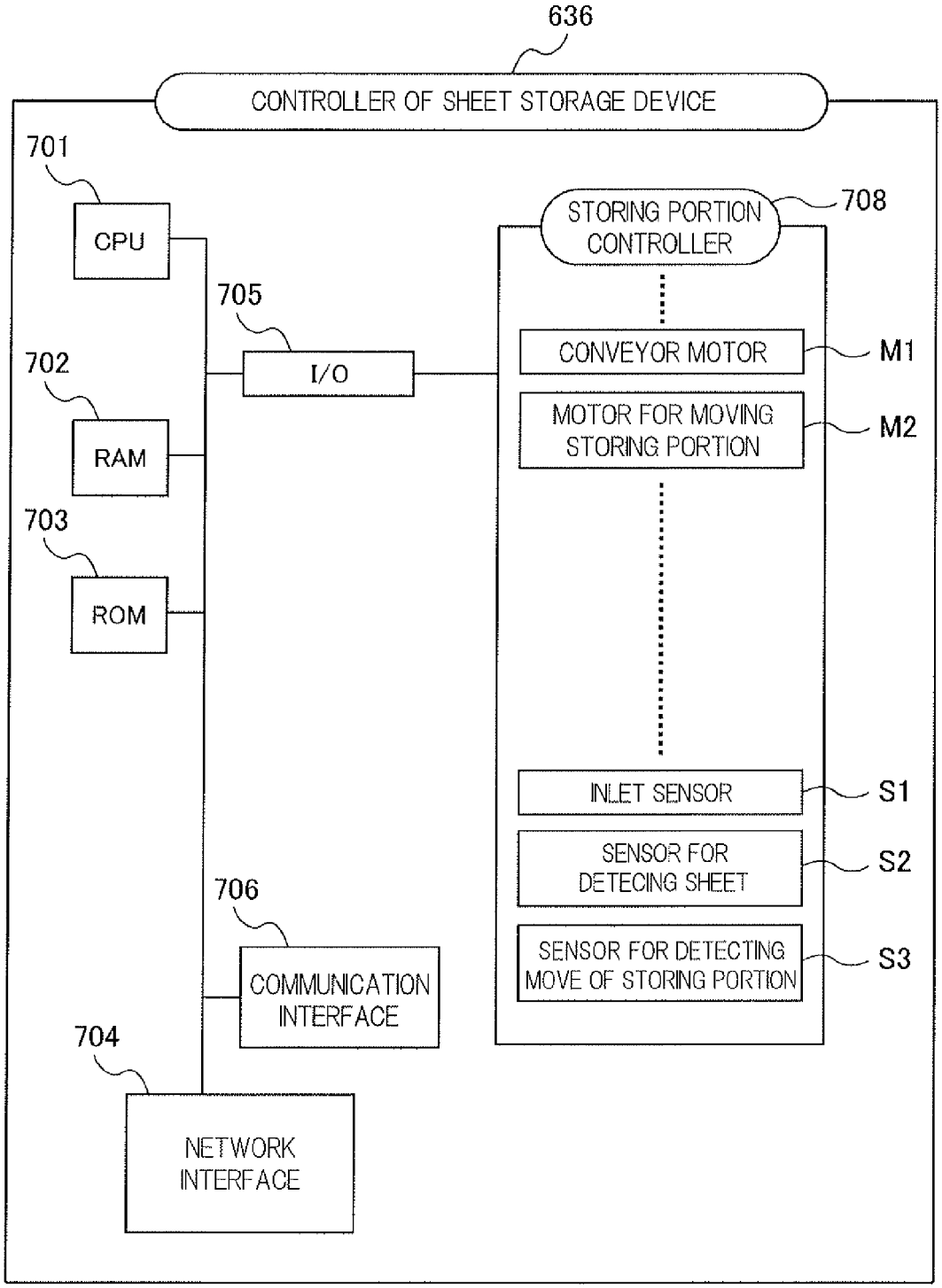
FIG. 10 is a control block diagram of a controller for controlling the sheet storage apparatus of the first embodiment.

As in FIG. 10, the sheet storage apparatus controller 636 includes the CPU 701, a RAM 702, a ROM 703, a storing portion controller 708 for controlling the sheet storage portion 330 and others. The controller 636 exchanges data by communicating with the CPU circuit portion 630 provided on the side of the apparatus body 200 through a communication interface 706. Then, the controller 636 executes various programs stored in the ROM 703 based on instructions from the CPU circuit portion 630 and controls the sheet storage apparatus 300 through the controller 708. When a sheet storage processing control is executed, for example, detection signals are taken into the CPU 701 from the various sensors for controlling the sheet storage apparatus 300 through an input/output (I/O) unit 705, such as the inlet sensor S1, the sheet present detection sensor S2 (e.g., sensors S2*a* through S2*e*), and the home position detection sensor S3 for detecting the movement of the sheet storage portion 330 described above. As noted above, the moving pulley 311*b* (FIG. 3) is provided coaxially with the motor M2 for moving the sheet storage portion 330, and the moving pulley 311*a* is provided on the side opposite from the moving pulley 311*b*. Through the controller 708, the CPU 701 drives the conveyor motor M1 and the motor M2, which is for moving the storage portion 330.

Figure 11:
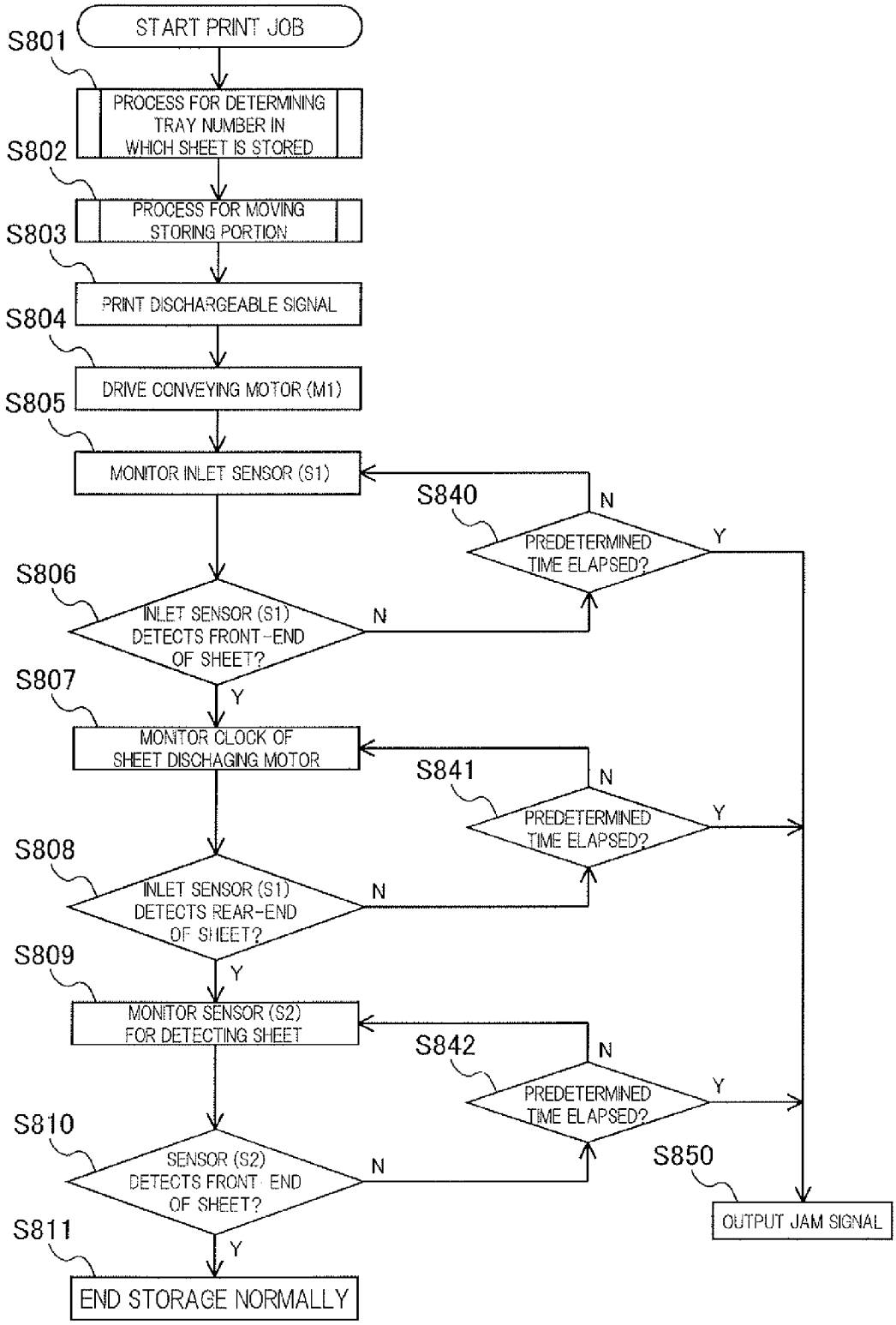
FIG. 11 is a flowchart showing processes for controlling sheet storing operations of the sheet storage apparatus of the first embodiment.

Next, the control of the sheet storing operation of the sheet storage apparatus 300 of the first embodiment will be explained with reference to FIGS. 11 through 13. FIG. 11 is a flowchart showing processes for controlling the sheet storing operations of the sheet storage apparatus 300 of the present embodiment, FIG. 12 is a flowchart showing processes for determining a tray number in which the sheet is stored, of the sheet storage apparatus 300 of the present embodiment, and FIG. 13 is a flowchart showing processes for moving the sheet storage portion of the sheet storage apparatus 300 of the present embodiment.

When a print Job is sent to the image forming apparatus 100 as shown in FIG. 11, the print Job starts and in connection with that, the controller 636 executes the process for determining a tray number in which the sheet is to be stored in Step S801.

Figure 12:
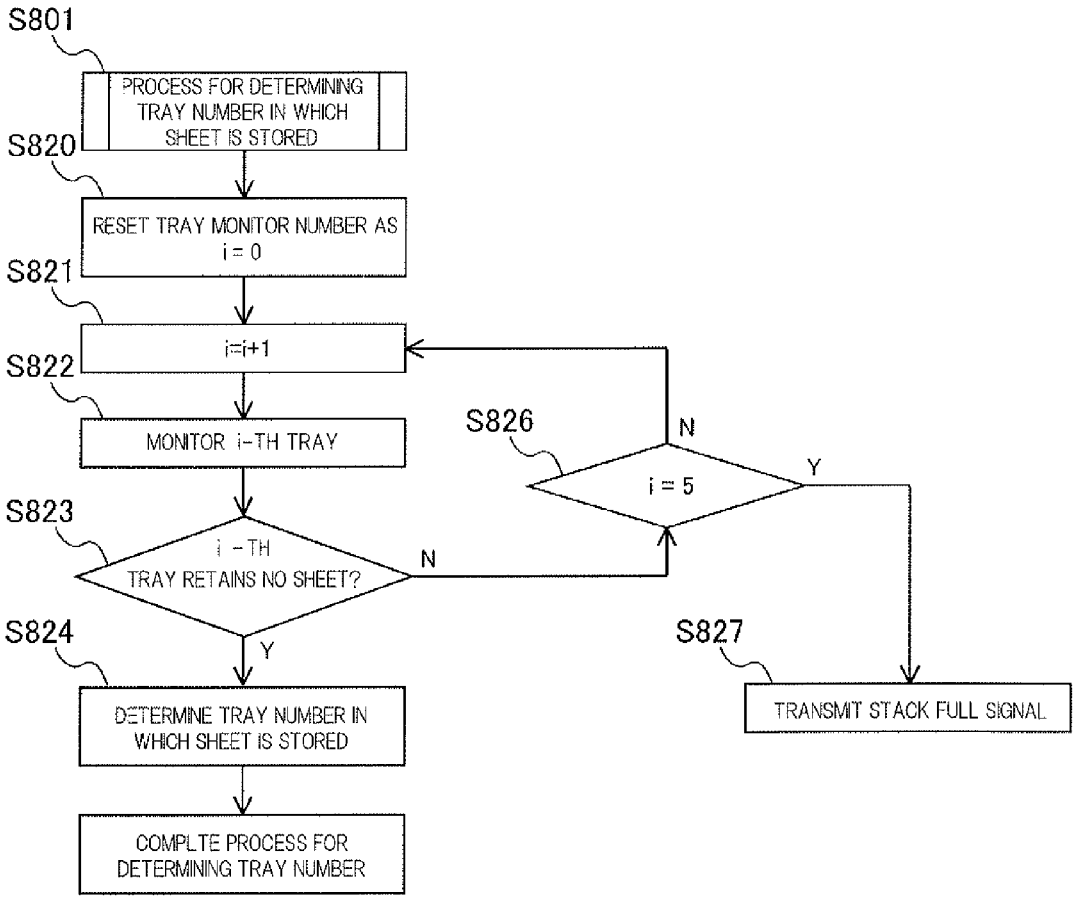
FIG. 12 is a flowchart showing processes for determining a tray number in which the sheet is stored, of the sheet storage apparatus of the first embodiment.
Figure 13:
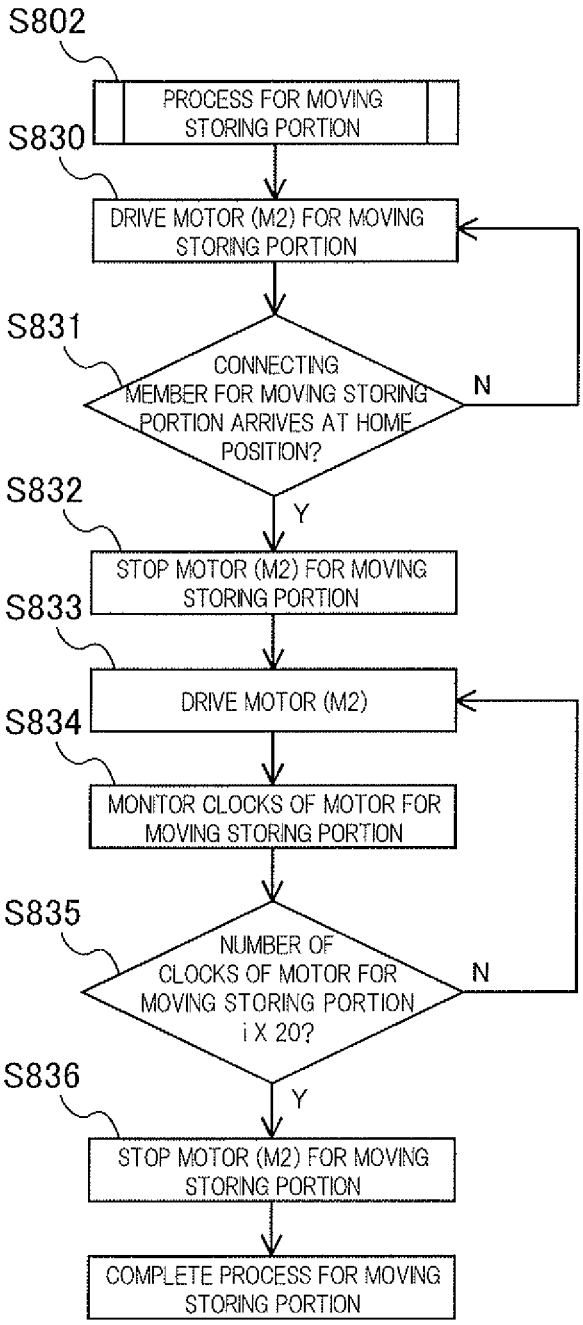
FIG. 13 is a flowchart showing processes for moving a sheet storage portion of the sheet storage apparatus of the first embodiment.

As noted, FIG. 12 is a flowchart showing processes for determining a tray number in which the sheet is stored, of the sheet storage apparatus 300. As the process for determining the tray number, the controller 636 resets a tray monitor number i for setting the sheet storage portion 330 in which the sheet is to be stored (i=0) in Step S820 as shown in FIG. 12. Next, the controller 636 executes a process of adding 1 to the tray monitor number in Step S821. Next, the controller 636 monitors the i-th (=1) sheet storage portion in Step S822 to discriminate whether or not the i-th sheet storage portion holds a sheet using the sensor S2 in Step S823. For example, the present detection sensor S2 (e.g., sensors S2*a* through S2*e*) may be used to determine whether the respective sheet storage portion 330 (e.g., sheet storage portions 330*a* through 330*e*) holds a sheet.

When the i-th (=1) sheet storage portion holds a sheet here (N in S823) (that is, the statement that the i-th tray retains no sheet is false), the controller 636 proceeds to Step S826 and judges whether or not i is 5, i.e., whether or not it is the last sheet storage portion 330 in Step S826. When i is not 5 (N in S826), the controller 636 adds 1 to the tray monitor number in Step S821 and judges whether or not the i-th (=2) sheet storage portion holds a sheet in Step S823.

When the evaluated sheet storage portion holds a sheet (N in Step S823) as described above, the controller 636 repeats this process until monitoring of, for example, the fifth sheet storage portion 330*e* is finished, i.e., until i turns to 5. Then, when the fifth sheet storage portion 330*e* holds a sheet, i.e., when i=5 and all of the sheet storage portions 330 hold sheets (Y in Step S826), the controller 636 transmits a "stack FULL" signal from the CPU 701 to the CPU circuit portion 630 in Step S827. It is noted that the CPU circuit portion 630 indicates that it is unable to store on a display, not shown, and provided on the manipulating portion 601 (FIG. 1) when the CPU circuit portion 630 receives this "stack FULL" signal.

When an i-th sheet storage portion holds no sheet (nil) (Y in Step S823) (that is, the statement that the i-th tray retains no sheet is true), the controller 636 determines the identification number of the tray in which the sheet is stored as the i-th tray in Step S824. By determining the number, the controller 636 issues an instruction to convey the sheet P to the sheet storage portion 330 whose number is i and completes the process for determining the number of the tray in which the sheet is to be stored.

After completing the process for determining the tray number of FIG. 12, the controller 636 shifts to the process for moving the sheet storage portion 330 in Step S802 shown in FIG. 11. As noted, FIG. 13 is a flowchart showing processes for moving the sheet storage portion 330 of the sheet storage apparatus 300. Then, as part of the process for moving the sheet storage portion 330, the controller 636 drives the motor M2 (FIG. 2) in Step S830 of FIG. 13 to move the connecting member 310 toward the home position, as shown in FIG. 2. In Step S831, the process determines whether the connecting member 310 for moving the sheet storage portion 330 has arrived at the home position. In response to determining the connecting member 310 for moving the sheet storage portion 330 has not arrived at the home position (N in Step S831), the process returns to Step S830. In response to determining the connecting member 310 for moving the sheet storage portion 330 has arrived at the home position (Y in Step S831), such as when the home position detection sensor S3 detects that the connecting member 310 has arrived at the home position in Step S831, the controller 636 stops the motor M2 once in Step S832.

Next, after Step S832 when the sheet storage portion 330 has arrived at the home position as described above, the controller 636 drives the motor M2 in Step S833 and counts a number of clocks of the motor M2 in Step S834. For example, based on the revolutions per minute of the motor M2, the motor M2 may output a signal and the controller 636 may count the number of clocks using the signal output from the motor M2. The controller 636 continues to drive the motor M2 and count the number of clocks of the motor M2 until the i-th sheet storage portion 330*i*, determined in the process of determining the tray number described above in connection with FIG. 12, comes to a position aligned with the conveying roller 301. In other words, when the receiving portion 360 of the sheet storage portion 330*i* is positioned above the curved conveyor guide 313 to receive a sheet P from the sheet conveying portion 314, the controller 636 stops the motor M2. To accomplish this, the process determines at Step 835 whether the number of clocks of the motor M2 are equal to a predetermined number of clocks from a set of predetermined number of clocks (such as i×20). In response to the process determining at Step 835 that the determined number of clocks of the motor M2 are not equal to the predetermined number of clocks (N at Step S835), the process returns to Step S833. In response to the process determining at Step 835 that the determined number of clocks of the motor M2 are equal to the predetermined number of clocks (y at Step S835), the process concludes that the i-th sheet storage portion 330*i* comes to the position aligned with the conveying roller 301 and the controller 636 stops the motor M2 in Step S836.

When such a process of FIG. 13 for moving the sheet storage portion 330*i* is completed, that is, when Step S802 of FIG. 11 is completed, the controller 636 (FIG. 9) outputs a print dischargeable signal to the CPU circuit portion 630 provided on the side of the apparatus body 200 in Step S803 in FIG. 11. The controller 636 also drives the conveyor motor M1 (FIG. 1) in Step S804 and, in Step S805, monitors arrival of a sheet P at the curved conveyor guide 313 using the inlet sensor S1 to prepare for the sheet P conveyed from the apparatus body 200. As noted above, a sheet P on which the image has been fixed is discharged by a pair of discharge rollers 110 from the apparatus body 200 as driven by a sheet discharge motor (not shown). Then, when the inlet sensor S1 detects a front-end of the sheet P (Y in Step S806), the controller 636 starts to monitor clocks of a sheet discharge motor in Step S807.

Recall that the sheet storage portions 330*a* through 330*e* are provided respectively with sensors S2 (e.g., S2*a* through S2*e*) for detecting whether or not a sheet P exists within the evaluated sheet holding portion 340. When the inlet sensor S1 detects a rear-end of the sheet after that (Y in Step S808), the controller 636 monitors the signal of the sensor S2 (e.g., S2*i*) in Step S809. Then, when the sensor S2 detects the front-end of the sheet (Y in Step S810), the controller 636 judges that the sheet P is held properly by the sheet holding portion 340 of the selected i-th sheet storage portion, and judges that the storage of the sheet P is normally completed in Step S811.

It is noted that, when the inlet sensor S1 does not detect the front-end of the sheet (N in Step S806), this state continues until a predetermined period of time (Y in Step S840). When the predetermined period of time is detected in Step S840 (Y in Step S840), the controller 636 outputs a jam signal in Step S850. When the inlet sensor S1 does not detect the rear-end of the sheet (N in Step S808), this state continues for a predetermined period of time. For example, when the number of clocks of the motor reaches a predetermined value (Y in Step S841), the controller 636 outputs the jam signal in Step S850. Still further, when the sensor S2 does not detect the front-end of the sheet (N in Step S810), this state continues for a predetermined period of time. For example, when the number of clocks of the motor reaches a predetermined value (Y in Step S842), the controller 636 outputs the jam signal in Step S850.

As described above, either one of the holding members 305*a* (FIG. 5) and 305*b* holds the preceding sheet P1 even when the succeeding sheet P2 is put into the sheet holding portion 340 while holding the preceding sheet P1. Therefore, it is possible to store the sheets without dropping the preceding sheet P1 in the condition in which the plurality of sheets P is set up. With this arrangement, it is possible to readily hold a plurality of sheets while setting up in the vertical direction and to improve the visibility and the readiness in taking out the sheet(s), even when no such processing as stapling is implemented. As a result, it is possible to suppress disorder of the vertically stacked sheets when taking out the sheet(s), and to prevent problems of the apparatus 100, such as a discharge error.

Still further, it is possible to insert the sheet P between the storage guide 304 and the holding members 305*a* and 305*b* by a weak force of just moving the holding members 305*a* and 305*b* that are movable in the direction of the arrow B (FIGS. 6A-6B and 7A-7B) by the thickness of the sheet P in the present embodiment. When the rear-end of the inserted sheet P passes through the conveyor roller 301, the gravity acting on the holding members 305*a* and 305*b* applies the nipping pressures F1 and F2 (FIGS. 6C and 7C) that nip the sheet P between the holding members 305*a* and 305*b* and the guide surface 304*a* of the storage guide 304 with the effect of the inclined portions 30313*a* and 30313*b* of the conveying guide 303. The sheet P1 is held by the sheet holding portion 340 by the nipping pressures F1 and F2 caused by the wedge effect. Then, because the wedge effect does not act if the sheet P, held between the holding members 305*a* and 305*b* and the storage guide 304, is pulled out in the depth direction and the upper direction of the image forming apparatus 100, it is possible to take out the sheet(s) P from the sheet holding portion 340 readily by one hand.

The restricting member 350 (FIGS. 6C and 7C) is provided above the sheet holding portion 340 in the present embodiment. As a result, it is possible to restrict sheets conveyed from the conveyor roller 301 and the driven roller 302, and a sheet led by the sheet, being conveyed, and to align the level of the sheets.

Still further, the five sheet storage portions 330*a-e* are disposed in parallel above the apparatus body 200 in the present embodiment, so that it is possible to increase a storage amount without widening an installation space. Still further, because the image forming apparatus 100 stores the sheets P by setting up in the vertical direction, it is unnecessary to widen the installation space even when a large-size sheet is to be stored.

Second Embodiment

Next, an image forming apparatus 100A (see FIG. 1) of a second embodiment will be explained with reference to FIGS. 14A through 16. Compared to the image forming apparatus 100 of the first embodiment that has the sheet holding portion 340 that holds the sheet P with the two holding portions 340*a* and 340*b*, the image forming apparatus 100A of the second embodiment is different from the image forming apparatus 100 in that the image forming apparatus 100A has a sheet holding portion 340A that is capable of holding the sheet P with a single holding portion. Therefore, the difference from the first embodiment, i.e., the sheet holding portion 340A of a sheet storage apparatus 300A (see FIG. 1 and FIG. 2), will be explained mainly in the second embodiment, and the same or corresponding parts as those of the first embodiment will be denoted by the same reference numerals and explanation thereof will be omitted here. It is noted that the parts in the second embodiment having the same configuration are regarded to have the same effects as those in the first embodiment.

Figure 14A:
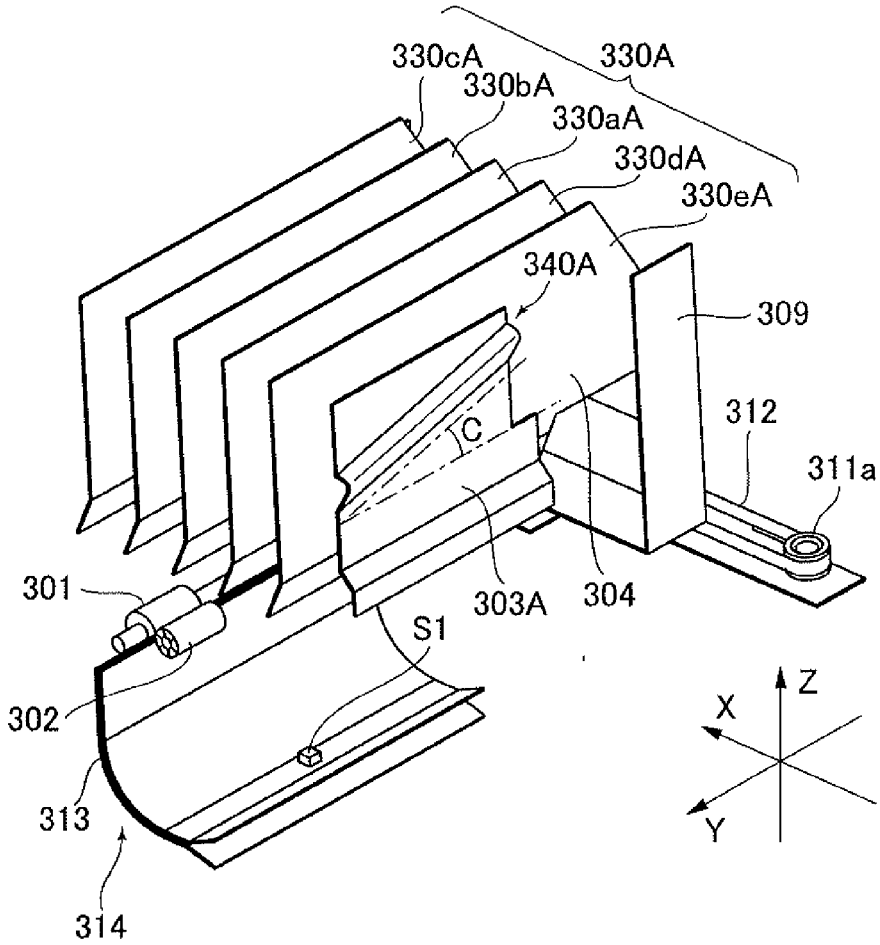
FIG. 14A is a perspective view of a sheet storage portion of the sheet storage apparatus of a second embodiment.

The sheet holding portion 340A of the second embodiment will be explained first with reference to FIGS. 14A and 14B. FIG. 14A is a perspective view of a sheet storage portion 330A (also see FIG. 1) of the sheet storage apparatus 300A of the second embodiment and FIG. 14B is a section view of the sheet holding portion 340A of the sheet storage portion 330A shown in FIG. 14A.

Figure 14B:
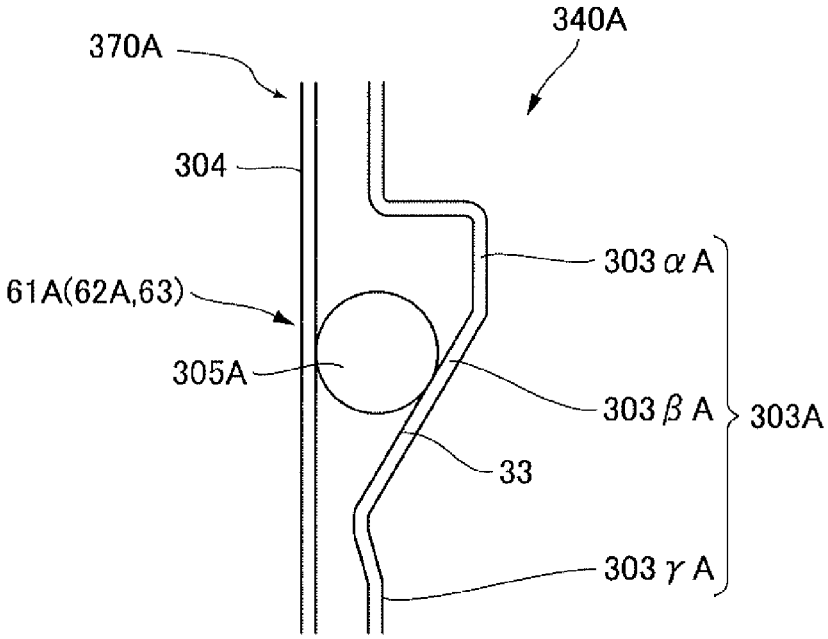
FIG. 14B is a section view of a sheet holding portion of the sheet storage portion shown in FIG. 14A.

As shown in FIGS. 14A and 14B, the sheet storage portion 330αA has a guide portion 370A which includes the storage guide 304 and a conveying guide 303A, and holding members 305A. These conveying guide 303A, and holding members 305A configure the sheet holding portion 340A. The sheet storage portion 330αA also includes edge restricting member 350 (FIG. 15D). The conveying guide 303A has a counterface wall portion 303αA, an inclined portion 303βA, and a lower wall portion 303γA. An inclined surface 33 of the inclined portion 303βA is provided at an angle with respect to the direction X while additionally inclining by a predetermined angle, i.e., an inclination angle C (FIG. 14A), with respect to the width direction Y orthogonal to the conveying direction of the sheet conveyed upward along the guide surface. The holding members 305A include a first holding member 305A1, a second holding member 305A2, and a third holding member 305A3, which are disposed between the storage guide 304 and the conveying guide 303A. The holding members 305A1, 305A2, and 305A3 roll in a range of the inclined portion 303βA and the counterface wall portion 303α*a* of the conveying guide 303A along the angled and inclined surface 33. The sheet holding portion 340A is arranged such that the first through third holding members 305A1, 305A2, and 305A3 are disposed at different positions in the vertical direction Z by being disposed at different positions in the width direction Y. That is, the inclined surface 33 of the inclined portion 303βA described above is also inclined by the predetermined angle C with respect to the width direction Y as described above. Then, the first through third holding members 305A1, 305A2, and 305A3, i.e., the first through third rolling members, are disposed to roll at different parts of the single inclined surface 33 of the inclined portion 303βA.

Next, an operation of holding a plurality of sheets P against the storage guide 304 by the sheet holding portion 340A will be explained with reference to FIGS. 15*a* through 15D. That is, an operation of inserting the succeeding sheet P2 in the state in which the preceding sheet P1 is held by the first through third holding members 305A1, 305A2, and 305A3 and of holding the preceding and succeeding sheets P1 and P2 will be explained in the second embodiment.

Figure 15A:
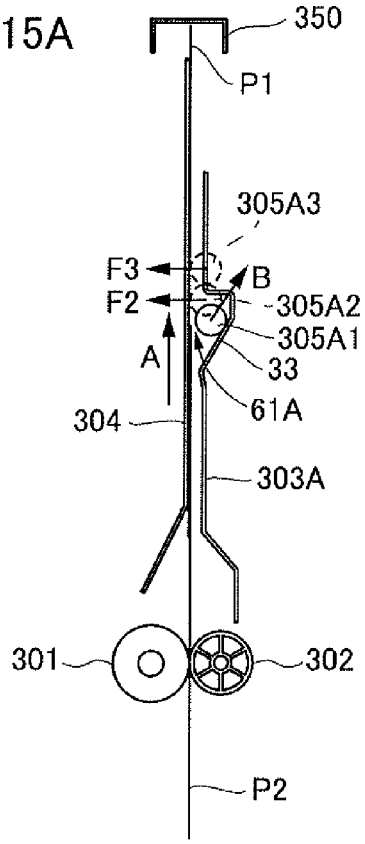
FIG. 15A illustrates a state when a succeeding sheet passes through a first holding member.
Figure 15B:
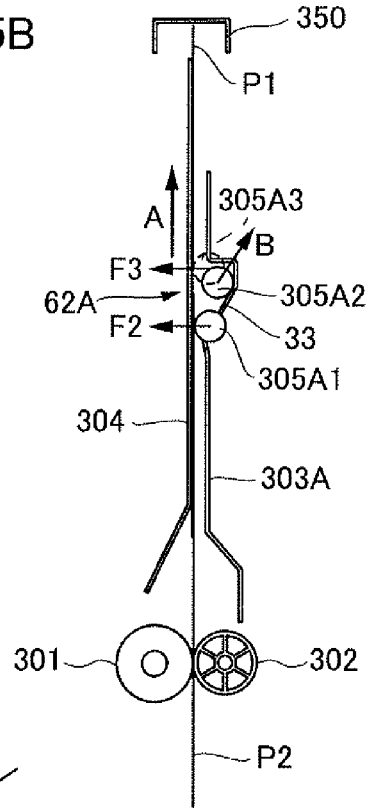
FIG. 15B illustrates a state when the succeeding sheet passes through a second holding member.
Figure 15C:
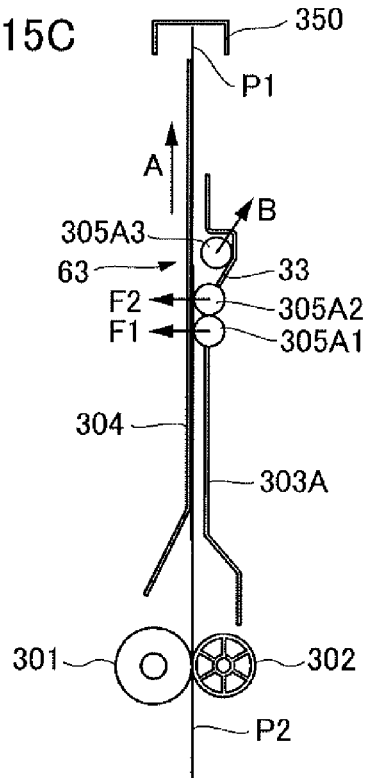
FIG. 15C illustrates a state when the succeeding sheet passes through a third holding member.
Figure 15D:
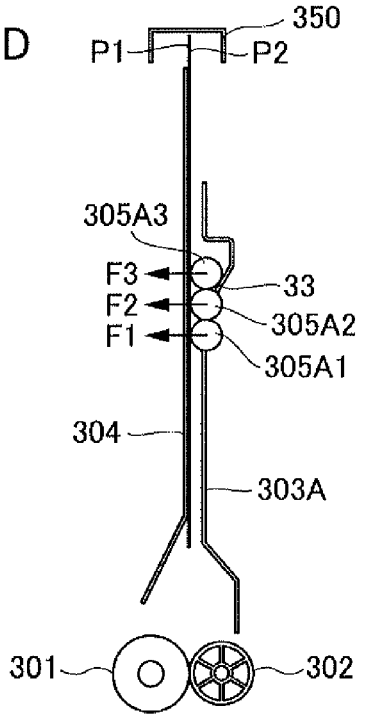
FIG. 15D illustrates a state when the preceding and succeeding sheets are held by the first, second and third holding members.

FIG. 15A illustrates a state when the succeeding sheet P2 passes through the first holding member 305A1, FIG. 15B illustrates a state when the succeeding sheet P2 passes through the second holding member 305A2, FIG. 15C illustrates a state when the succeeding sheet P2 passes through the third holding member 305A3, and FIG. 15D illustrates a state when the preceding and succeeding sheets P1 and P2 are held by the first, second and third holding members 305A1, 305A2, and 305A3.

When the succeeding sheet P2 is conveyed to the sheet storage portion 330αA in the state in which the preceding sheet P1 is held by the sheet holding portion 340A, the first holding member 305A1 is pressed by the succeeding sheet P2 that tries to enter the first nip portion 61A formed between the first holding member 305A1 and the storage guide 304 as shown in FIG. 15A. When the first holding member 305A1 is pressed by the succeeding sheet P2, the first holding member 305A1 moves (rolls) and elevates by the thickness of the succeeding sheet P2 in the direction of the arrow B (FIG. 15A) along the inclined surface 33 of the inclined portion 303βA. The succeeding sheet P2 can therefore pass through the first nip portion 61A.

At this time, while a nipping pressure F1 caused by the first holding member 305A1 is released as the first holding member 305A1 moves up, the preceding sheet P1 is held by a nipping pressure F2 of the second holding member 305A2 and a nipping pressure F3 of the third holding member 305A3. As a result, even if the nipping pressure F1 caused by the first holding member 305A1 is released, no defective phenomenon such as a fall of the preceding sheet P1 occurs. Still further, when the succeeding sheet P2 passes through the first nipping portion 61A, the nipping pressure F1 (=M/tan θ) in the direction of the storage guide 304 is applied to the preceding and succeeding sheets P1 and P2 by the gravity M acting on the first holding member 305A1. However, the succeeding sheet P2 can pass through the first nipping portion 61A because the succeeding sheet P2 presses the first holding member 305A1 by the conveying force of the conveying roller 301 and because the first holding member 305A1 is arranged to be freely rollable.

When the succeeding sheet P2 is conveyed upward further by the conveying roller 301, the second holding member 305A2 is pressed by the succeeding sheet P2 that tries to enter the second nipping portion 62A formed between the second holding member 305A2 and the storage guide 304 as shown in FIG. 15B. When the second holding member 305A2 is pressed by the succeeding sheet P2, the second holding member 305A2 moves (rolls) and elevates by the thickness of the succeeding sheet P2 in the direction of the arrow B along the inclined surface 33 of the inclined portion 303βA. As a result, the succeeding sheet P2 can pass through the second nipping portion 62A.

At this time, while the nipping pressure F2 caused by the second holding member 305A2 is released as the second holding member 305A2 moves up, the preceding and succeeding sheets P1 and P2 are held by the nipping pressure F1 of the first holding member 305A1 and the nipping pressure F3 of the third holding member 305A3. This means that even if the nipping pressure F2 caused by the second holding member 305A2 is released, no defective phenomenon such as the fall of the preceding and succeeding sheets P1 and P2 occurs. It is noted that when the succeeding sheet P2 passes through the second nipping portion 62A, the nipping pressure F2 (=M/tan θ) in the direction of the storage guide 304 is applied to the preceding and succeeding sheets P1 and P2 by the gravity M acting on the second holding member 305A2 in this case also. However, the succeeding sheet P2 can pass through the second nipping portion 62A because the succeeding sheet P2 presses the second holding member 305A2 by the conveying force of the conveying roller 301 and because the second holding member 305A2 is formed to be freely rollable.

When the succeeding sheet P2 is conveyed upward still further by the conveying roller 301, the third holding member 305A3 is pressed by the succeeding sheet P2 that tries to enter the third nipping portion 63 formed between the third holding member 305A3 and the storage guide 304 as shown in FIG. 15C. When the third holding member 305A3 is pressed by the succeeding sheet P2, the third holding member 305A3 moves (rolls) and elevates by the thickness of the succeeding sheet P2 in the direction of the arrow B along the inclined surface 33 of the inclined portion 303βA. As a result, the succeeding sheet P2 can pass through the third nipping portion 63.

At this time, while the nipping pressure F3 caused by the third holding member 305A3 is released as the third holding member 305A3 moves up, the preceding sheet P1 and the succeeding sheet P2 are held by the nipping pressure F1 of the first holding member 305A1 and the nipping pressure F2 of the second holding member 305A2. As a result, even if the nipping pressure F3 caused by the third holding member 305A3 is released, no defective phenomenon such as the fall of the preceding and succeeding sheets P1 and P2 occurs. It is noted that when the succeeding sheet P2 passes through the third nipping portion 63, the nipping pressure F3 (=M/tan θ) in the direction of the storage guide 304 is applied to the preceding and succeeding sheets P1 and P2 by the gravity M acting on the third holding member 305A3 in this case also. However, the succeeding sheet P2 can pass through the third nipping portion 63 because the succeeding sheet P2 presses the third holding member 305A3 by the conveying force of the conveying roller 301 and because the third holding member 305A3 is formed to be freely rollable.

As described above, even when the succeeding sheet P2 enters the sheet holding portion 340A in the state in which the preceding sheet P1 is held, either of the first, second, and third holding members 305A1, 305A2 and 305A3 hold the preceding and succeeding sheets P1 and P2. This arrangement allows the plurality of sheets P to be stored in the sheet storage portion 330αA.

Figure 16:
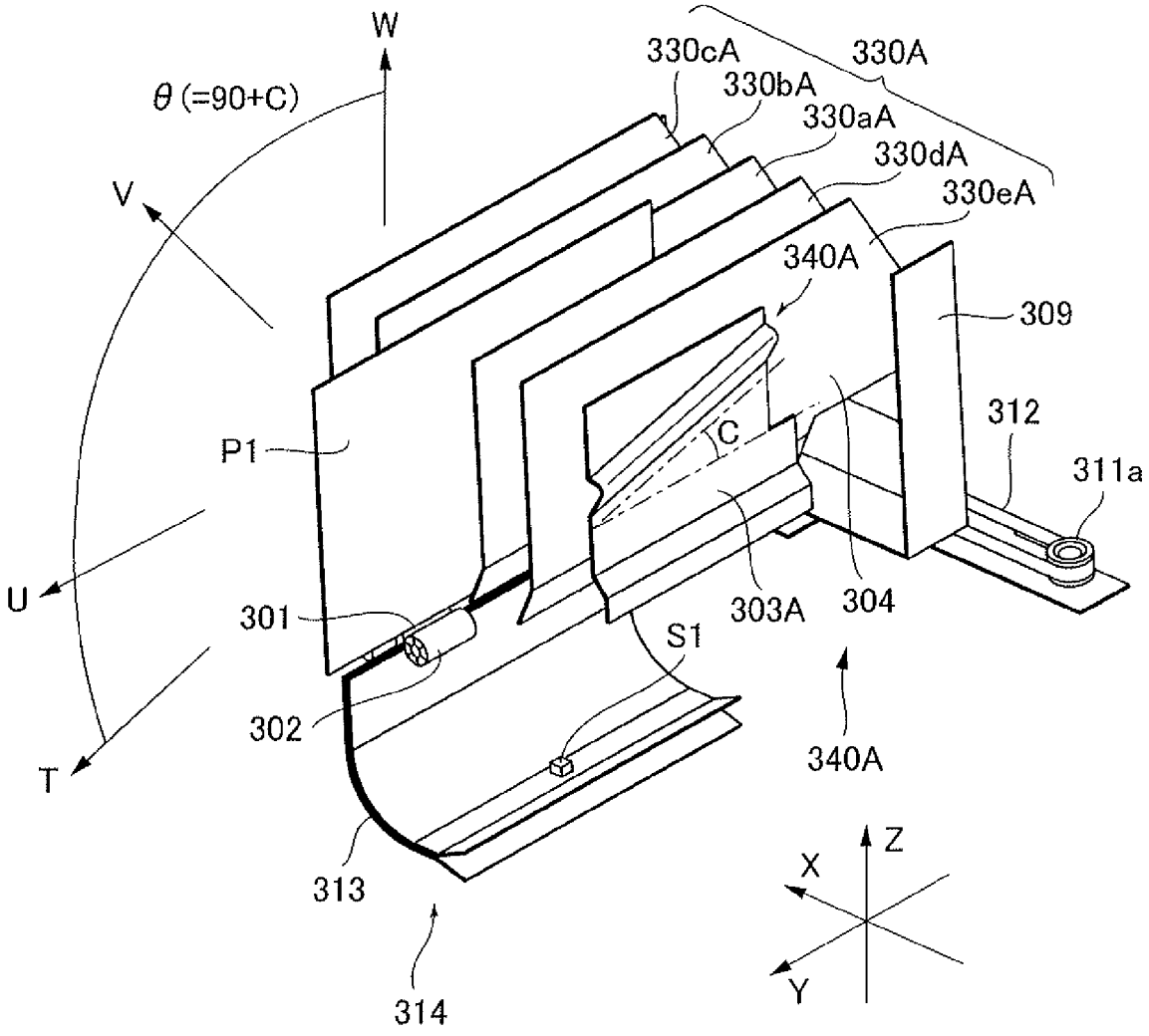
FIG. 16 is a perspective view showing a condition of sheets held by the sheet storage portion.

FIG. 16 shows a state of the sheet P held in the sheet storage portion 330αA. A sheet holding portion 340A is disposed at the back side in the depth direction Y, i.e., in the width direction or the sheet take-out direction, orthogonal to the sheet conveying direction as shown in FIG. 16. As a result, when the sheet P is held by the sheet holding portion 340A applicable to the sheet storage portion 330αA, the near side of the sheet P projects out of the near side of the sheet storage portion 330αA, i.e., of the near side of the apparatus body 200.

Still further, a length in a height direction, i.e., in the vertical direction Z, of the sheet holding portion 340A of the sheet storage portion 330αA is set so that an upper part of the stored sheet P projects. That is, lengths in the height and depth directions of the sheet storage portion 330αA are set so that the downstream-side end in the sheet conveying direction and the near-side end of the stored sheet P project out of the sheet storage portion 330αA.

As described above, the second embodiment makes it possible to dispose the rolling members 305A1 through 305A3, i.e., the plurality of holding members 305A, at the vertically different positions using the single inclined surface 33, as compared to the first embodiment and to hold the plurality of sheets P stably. That is, the conveying guide 303*b* can dispose the plurality of rolling members 305A1 through 305A3 at the vertically different positions if the conveying guide 303*b* has at least one inclined surface 33. Still further, because the inclined portion 303βA is formed to be inclined by C degrees with respect to the width direction, a take-out range is widened by C degrees. With this arrangement, the sheet P stored in the sheet storage portion 330αA can be taken out in a range of a direction T (FIG. 16) obliquely downward on the near side of the apparatus body 200, the direction U on the near side of the apparatus body 200, the direction V obliquely upward on the near side of the apparatus body 200 and the upward direction W indicated by an angle θ+C in FIG. 16. Thus, the part of the sheet P in this range is effective as a tong hold in taking out the sheet P.

It is noted that although the rolling member is used as the holding member in the first and second embodiments described above, the holding member need not always be a rolling member. For instance, the holding member may be formed by a brush whose stream of hairs is oriented upward or by a flexible member such as rubber which is oriented upward. That is, the holding member may have any configuration as long as the holding member forms the nip portion with the storage guide 304, allows the sheet to be conveyed upward to pass through the nip portion, and can hold the sheet whose front-end has passed through the nip portion by restricting the downward movement of the sheet.

Still further, although the holding member is constructed by the columnar rolling member that rolls on the inclined surface in the first and second embodiments described above, the holding member may be a globular, cylindrical, or spindle-shaped member. Furthermore, an outer circumference of the rolling member may be surrounded by sponge or rubber.

Figure 17:
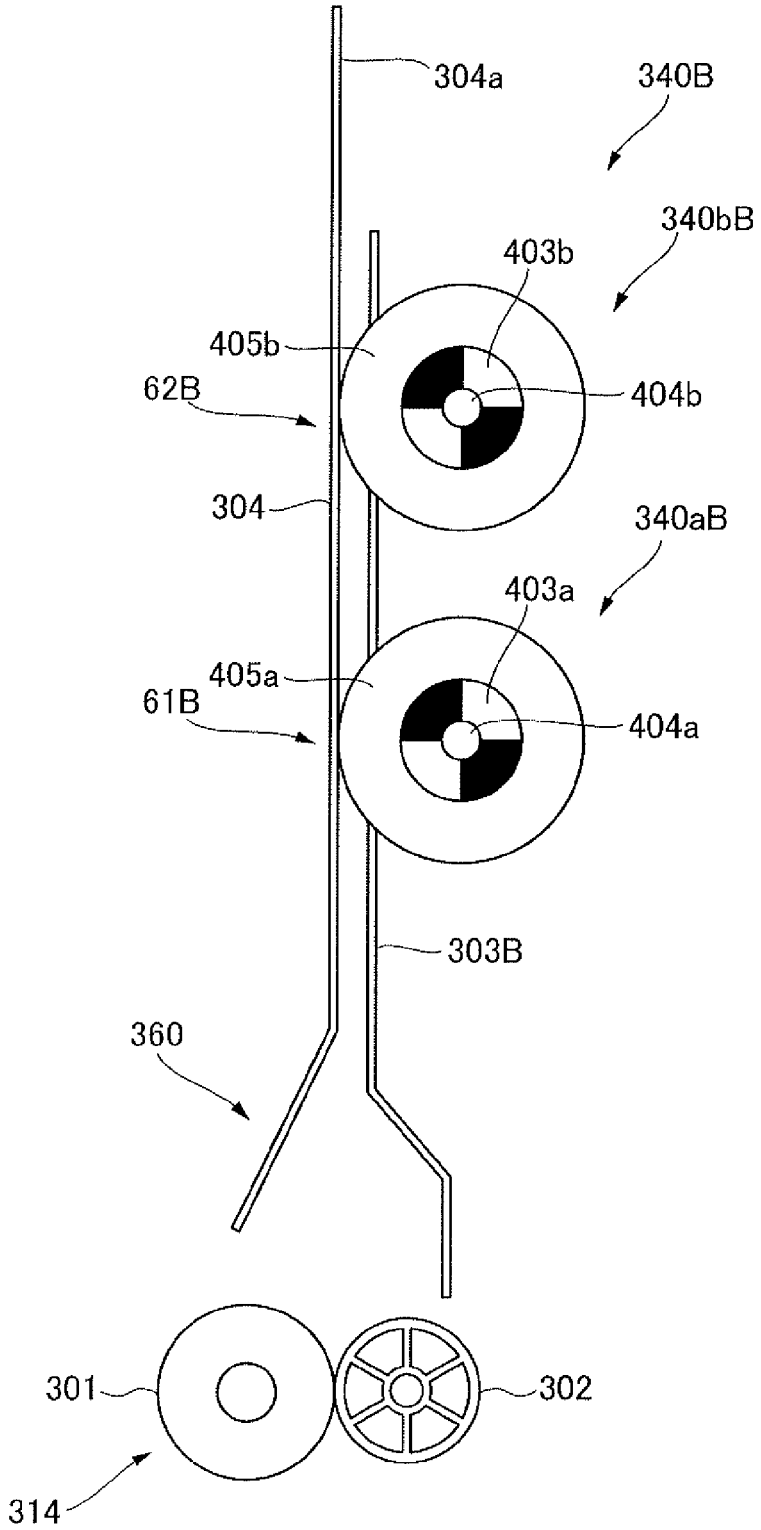
FIG. 17 is a schematic diagram showing another configuration of the holding members of the first and second embodiments.

FIG. 17 is a schematic diagram showing another configuration of the holding members of the first and second embodiments. The sheet holding portion 340B has a first holding portion 340*a*B and a second holding portion 340*b*B. The rolling member may be constructed not by the roller that rolls on the inclined surface but by a roller provided through an intermediary of a one-way clutch. For instance, the sheet storage portion 330 may include a first roller 405*a* provided through an intermediary of a first one-way clutch 403*a* as a first rolling member and a second roller 405*b* provided through an intermediary of a second one-way clutch 403*b* as a second rolling member, as shown in FIG. 17.

More specifically, the first rolling member has a first stationary shaft 404*a*, the first one-way clutch 403*a* described above, and the first roller 405*a*, wherein the first stationary shaft 404*a* is supported to not rotate with respect to the conveying guide 303B. Still further, the first one-way clutch 403*a* is arranged so that the clutch runs idle with respect to the first stationary shaft 404*a* in a direction of following the sheet P to be conveyed upwardly and so that the clutch engages with the first stationary shaft 404*a* in the opposite direction. Still further, the first roller 405*a* is mounted on the first stationary shaft 404*a* through the intermediary of the first one-way clutch 403*a* and is composed of an elastic foam member. Therefore, the first roller 405*a* elastically deforms by abutting the storage guide 304 and forms the first nipping portion 61B together with the storage guide 304.

Meanwhile, similarly to the first rolling member, the second rolling member also has a second stationary shaft 404*b*, a second one-way clutch 403*b* and a second roller 405*b*. While the second stationary shaft 404*b*, the second one-way clutch 403*b*, and the second roller 405*b* have the similar structure to the first rolling member, the second stationary shaft 404*b* is disposed so that its vertical position is different from that of the first stationary shaft 404*a*. Specifically, the second stationary shaft 404*b* is disposed above the first stationary shaft 404*a* along the storage guide 304 and the second nipping portion 62B is formed between the storage guide 304 and the second roller 405*b*.

Therefore, when the sheet P is conveyed from the sheet conveying portion 314 to the receiving portion 360 of the sheet storage portion 330αA, the first roller 405*a* turns clockwise by following the sheet P conveyed upward to enter the first nipping portion 61B and allows the sheet P to pass through the first nipping portion 61B. When the sheet P is conveyed upward further along the guide surface of the storage guide 304, the second roller 405*b* turns clockwise by the sheet P trying to enter the second nipping portion 62B and allows the sheet P to pass through the second nipping portion 62B. Then, when the conveyance of the sheet P ends, the sheet P is held by nipping pressure (pressing force) from the first and second rollers 405*a* and 405*b* because the first and second rollers 405*a* and 405*b* do not rotate counterclockwise.

Furthermore, in the case of the held sheet P1 exists, the nipping pressure of at least either one of the first and second rollers 405*a* and 405*b* is applied to the held sheet P1 also when the succeeding sheet P2 enters one of the first and second nip portions 61B and 62B. It is therefore possible to prevent the held sheet P1 from falling.

Still further, although the storage guide 304 is set up substantially vertically in the embodiments described above, the storage guide 304 (the guide surface 304*a*) may be formed within a range of 45 degrees forward and backwards with respect to a vertical direction.

Furthermore, the inventions described in the embodiments may be combined in any manner. For instance, it is possible to combine the sheet holding portions described in the first and second embodiments or to provide a plurality of sheet holding portions of the second embodiment. In addition, the number of the holding portions is not limited to be two, and that three or more holding portions may be provided. It is also possible to divide the first and second rolling members of the first embodiment in the width direction and to form the holding members with a plurality of groups of rolling members.

While the embodiments of the invention have been explained above, the invention is not limited to the embodiments described above. Still further, the effects described in the embodiments of the invention are merely the most suitable effects brought about by the invention and the effects of the invention are not limited by those described in the embodiments of the invention.

Aspects of the present invention can also be realized by a computer (such as a CPU or MPU) of a system or apparatus that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device, e.g., computer-readable medium. In an example, a computer-readable storage medium may store a program that causes a sheet storage apparatus to perform a method described herein. In another example, a central processing unit (CPU) may be configured to control at least one unit utilized in a method or apparatus described herein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-130511 filed on Jun. 10, 2011, and Japanese Patent Application No. 2012-116714 filed on May 22, 2012 which are hereby incorporated by reference herein in its entirety.

What is claimed is:

1. A sheet storage apparatus, comprising:

a sheet conveying portion configured to convey a sheet; and a sheet storage portion configured to receive the sheet as conveyed upward from below by the sheet conveying portion and to store the sheet in a vertical direction, the sheet storage portion including:

a guide portion having a guide surface set up in the vertical direction to guide the sheet, a first holding member configured to form a first nipping portion between the first holding member and the guide surface, and to hold the sheet at the first nipping portion so as to permit the sheet to be conveyed upward only to pass through the first nipping portion and to restrict the sheet from moving downward, and a second holding member configured to form a second nipping portion between the second holding member and the guide surface, and to hold the sheet at the second nipping portion so as to permit the sheet to be conveyed upward only to pass through the second nipping portion and to restrict the sheet from moving downward, the second holding member being disposed downstream of the first holding member in a sheet conveying direction.

2. The sheet storage apparatus according to claim 1, wherein the first holding member is a first rolling member configured to permit the sheet to be conveyed upward to pass through the first nipping portion by rolling in response to the sheet entering the first nipping portion, and the second holding member is a second rolling member configured to permit the sheet to be conveyed upward to pass through the second nipping portion by rolling in response to the sheet entering the second nipping portion, wherein, in response to the sheet to be conveyed upward entering the first nipping portion, the second rolling member applies a nipping pressure to a held sheet at the second nipping portion to restrict the held sheet from moving downward, and wherein, in response to the sheet to be conveyed upward entering the second nipping portion, the first rolling member applies a nipping pressure to the held sheet at the first nipping portion to restrict the held sheet from moving downward.

3. The sheet storage apparatus according to claim 2, wherein the sheet storage portion further includes at least one inclined surface provided to face the guide surface, wherein the at least one inclined surface is inclined so that a first distance between an upper part of the at least one inclined surface and the guide surface is greater than a second distance between a lower part of the at least one inclined surface and the guide surface, wherein the first rolling member is provided to roll between the guide surface and the at least one inclined surface along the at least one inclined surface, and wherein the second rolling member is provided to roll between the guide surface and the at least one inclined surface along the at least one inclined surface.

4. The sheet storage apparatus according to claim 3, wherein the sheet storage portion includes, as the at least one inclined surface, a first inclined surface on which the first rolling member rolls, and a second inclined surface on which the second rolling member rolls.

5. The sheet storage apparatus according to claim 3, wherein the at least one inclined surface is provided, as a single inclined surface, to incline by a predetermined angle with respect to a width direction orthogonal to the sheet conveying direction along the guide surface, and wherein the first and second rolling members are disposed so that their widthwise positions are different, and that they roll at different parts of the single inclined surface.

6. The sheet storage apparatus according to claim 2, wherein the first rolling member includes a first stationary shaft, a first one-way clutch configured to turn idly with respect to the first stationary shaft in a direction following the sheet to be conveyed upward and to engage with the first stationary shaft in a reverse direction, and a first roller attached to the first stationary shaft through an intermediary of the first one-way clutch, and wherein the second rolling member includes a second stationary shaft disposed at a vertically different position from the first stationary shaft, a second one-way clutch configured to turn idly with respect to the second stationary shaft in the direction following the sheet to be conveyed upward and to engage with the second stationary shaft in the reverse direction, and a second roller attached to the second stationary shaft through an intermediary of the second one-way clutch.

7. The sheet storage apparatus according to claim 1, wherein the sheet storage portion further includes a restricting member configured to restrict a front-end position of a stored sheet.

8. The sheet storage apparatus according to claim 1, wherein the sheet storage portion is a plurality of the sheet storage portions disposed in parallel in a horizontal direction and arranged to be movable in the horizontal direction, the sheet storage apparatus further comprising:

a driving unit configured to move the plurality of sheet storage portions so that a receiving portion, configured to receive the sheet and selected out of the plurality of sheet storage portions, is aligned above the sheet conveying portion.

9. An image forming apparatus, comprising:

an image forming portion configured to form images on a sheet;

a sheet conveying portion configured to convey the sheet; and a sheet storage portion configured to receive the sheet as conveyed upward from below by the sheet conveying portion and to store the sheet in a vertical direction, the sheet storage portion including:

a guide portion having a guide surface set up in the vertical direction to guide the sheet, a first holding member configured to form a first nipping portion between the first holding member and the guide surface, and to hold the sheet at the first nipping portion so as to permit the sheet to be conveyed upward only to pass through the first nipping portion and to restrict the sheet from moving downward, and a second holding member configured to form a second nipping portion between the second holding member and the guide surface, and to hold the sheet at the second nipping portion so as to permit the sheet to be conveyed upward only to pass through the second nipping portion and to restrict the sheet from moving downward, the second holding member being disposed downstream of the first holding member in a sheet conveying direction.

10. The image forming apparatus according to claim 9, wherein the first holding member is a first rolling member configured to permit the sheet to be conveyed upward to pass through the first nipping portion by rolling in response to the sheet entering the first nipping portion, and the second holding member is a second rolling member configured to permit the sheet to be conveyed upward to pass through the second nipping portion by rolling in response to the sheet entering the second nipping portion, wherein, in response to the sheet to be conveyed upward entering the first nipping portion, the second rolling member applies a nipping pressure to a held sheet at the second nipping portion to restrict the held sheet from moving downward, and wherein, in response to the sheet to be conveyed upward entering the second nipping portion, the first rolling member applies a nipping pressure to the held sheet at the first nipping portion to restrict the held sheet from moving downward.

11. The image forming apparatus according to claim 10, wherein the sheet storage portion further includes at least one inclined surface provided to face the guide surface, the at least one inclined surface inclined so that a first distance between an upper part of the at least one inclined surface and the guide surface is greater than a second distance between a lower part of the at least one inclined surface and the guide surface, and wherein the first rolling member is provided to roll between the guide surface and the at least one inclined surface along the at least one inclined surface, and wherein the second rolling member is provided to roll between the guide surface and the at least one inclined surface along the at least one inclined surface.

12. The image forming apparatus according to claim 11, wherein the sheet storage portion includes, as the at least one inclined surface, a first inclined surface on which the first rolling member rolls, and a second inclined surface on which the second rolling member rolls.

13. The image forming apparatus according to claim 11, wherein the at least one inclined surface is provided, as a single inclined surface, to incline by a predetermined angle with respect to a width direction orthogonal to the sheet conveying direction along the guide surface, and wherein the first and second rolling members are disposed so that their widthwise positions are different, and that they roll at different parts of the single inclined surface.

14. The image forming apparatus according to claim 10, wherein the first rolling member includes a first stationary shaft, a first one-way clutch configured to turn idly with respect to the first stationary shaft in a direction following the sheet to be conveyed upward and to engage with the first stationary shaft in a reverse direction, and a first roller attached to the first stationary shaft through an intermediary of the first one-way clutch, and wherein the second rolling member includes a second stationary shaft disposed at a vertically different position from the first stationary shaft, a second one-way clutch configured to turn idly with respect to the second stationary shaft in the direction following the sheet to be conveyed upward and to engage with the second stationary shaft in the reverse direction, and a second roller attached to the second stationary shaft through an intermediary of the second one-way clutch.

15. The image forming apparatus according to claim 9, wherein the sheet storage portion further includes a restricting member configured to restrict a front-end position of a stored sheet.

16. The sheet storage apparatus according to claim 9, wherein the sheet storage portion is a plurality of the sheet storage portions disposed in parallel in a horizontal direction and arranged to be movable in the horizontal direction, the sheet storage apparatus further comprising:

a driving unit configured to move the plurality of sheet storage portions so that a receiving portion, configured to receive the sheet and selected out of the plurality of sheet storage portions, is aligned above the sheet conveying portion.

* * * * *